US010714837B1

(12) United States Patent
Rumsey et al.

(10) Patent No.: US 10,714,837 B1
(45) Date of Patent: Jul. 14, 2020

(54) ARRAY ANTENNA WITH DUAL POLARIZATION ELEMENTS

(71) Applicant: FIRST RF Corporation, Boulder, CO (US)

(72) Inventors: Ian S. Rumsey, Thornton, CO (US); Sean P. McDevitt, Thornton, CO (US); Robert T. Rebich, Boulder, CO (US); Dean A. Paschen, Lafayette, CO (US); Luke S. Sankey, Berthoud, CO (US)

(73) Assignee: FIRST RF Corporation, Boulder, CO (US)

( * ) Notice: Subject to any disclaimer, the term of this patent is extended or adjusted under 35 U.S.C. 154(b) by 92 days.

(21) Appl. No.: 16/176,217

(22) Filed: Oct. 31, 2018

(51) Int. Cl.

| | |
|---|---|
| ***H01Q 13/10*** | (2006.01) |
| ***H01Q 21/00*** | (2006.01) |
| ***H01Q 15/24*** | (2006.01) |
| ***H01Q 21/06*** | (2006.01) |
| ***H01Q 1/48*** | (2006.01) |

(52) U.S. Cl.
CPC ..... *H01Q 15/24* (2013.01); *H01Q 1/48* (2013.01); *H01Q 13/10* (2013.01); *H01Q 21/064* (2013.01)

(58) Field of Classification Search
CPC .... H01Q 13/085; H01Q 21/064; H01Q 21/24; H01Q 13/08; H01Q 13/10; H01Q 1/38; H01Q 1/48; H01Q 13/106; H01Q 25/001; H01Q 21/0093; H01Q 3/30; H01Q 9/40; H01Q 13/0275; H01Q 21/00; H01Q 21/06; H01Q 21/061; H01Q 21/08; H01Q 5/10; H01Q 9/285; H01Q 15/24; H01Q 15/244; H01Q 17/008; H01Q 1/28; H01Q 1/523; H01Q 1/525; H01Q 21/0056; H01Q 21/065; H01Q 21/067; H01Q 21/245; H01Q 21/293; H01Q 21/30; H01Q 23/00; H01Q 3/24; H01Q 3/26; H01Q 3/2658; H01Q 5/35; H01Q 9/0435; H01Q 9/16; H01Q 9/26
See application file for complete search history.

(56) References Cited

U.S. PATENT DOCUMENTS 3,854,140 A * 12/1974 Ranghelli ..... H01Q 3/38 343/756
4,001,834 A * 1/1977 Smith ..... H01Q 13/08 343/754
4,978,965 A * 12/1990 Mohuchy ..... H01Q 13/085 343/727
5,023,623 A * 6/1991 Kreinheder ..... H01Q 1/281 343/725

(Continued)

*Primary Examiner* — Tho G Phan
(74) *Attorney, Agent, or Firm* — Lathrop GPM LLP

(57) ABSTRACT

An array antenna with dual polarization elements is provided. Each dual polarization element comprises a first sub-element and a second sub-element, each of which comprises a radiator that is embodied in and/or on a planar member and a balanced feed for the radiator that divides the radiator into two sections that that are mirror images of one another relative to a plane that passes through the balanced feed structure and is perpendicular to the planar member. Further, the radiator of the first sub-element is positioned to lie in an isolation plane associated with the second sub-element. Two such elements are positioned with respect to one another so that the planar members associated with the first elements are coplanar.

19 Claims, 18 Drawing Sheets

(56) References Cited

U.S. PATENT DOCUMENTS

| | | | | |
|---|---|---|---|---|
| 5,461,392 | A * | 10/1995 | Mott | H01Q 13/085 343/705 |
| 6,107,965 | A | 8/2000 | Christ | |
| 6,552,691 | B2 * | 4/2003 | Mohuchy | H01Q 13/085 343/770 |
| 6,650,291 | B1 | 11/2003 | West et al. | |
| 6,985,123 | B2 | 1/2006 | Gottl | |
| 7,064,712 | B2 | 6/2006 | Munk | |
| 7,138,952 | B2 * | 11/2006 | Mcgrath | H01Q 1/38 343/751 |
| 7,629,939 | B2 | 12/2009 | Deng et al. | |
| 8,098,189 | B1 | 1/2012 | Woodell et al. | |
| 8,325,093 | B2 | 12/2012 | Holland et al. | |
| 8,405,564 | B2 | 3/2013 | Kindt et al. | |
| 8,736,504 | B1 | 5/2014 | West et al. | |
| 8,988,274 | B2 | 3/2015 | Zhang et al. | |
| 9,000,996 | B2 | 4/2015 | Holland et al. | |
| 9,778,357 | B2 | 10/2017 | Zhang et al. | |
| 9,806,432 | B2 | 10/2017 | Little et al. | |
| 2013/0082893 | A1 | 4/2013 | Wang et al. | |
| 2014/0218251 | A1 | 8/2014 | Waschenko et al. | |
| 2015/0077300 | A1 | 3/2015 | Wang et al. | |

* cited by examiner

Fig. 1A
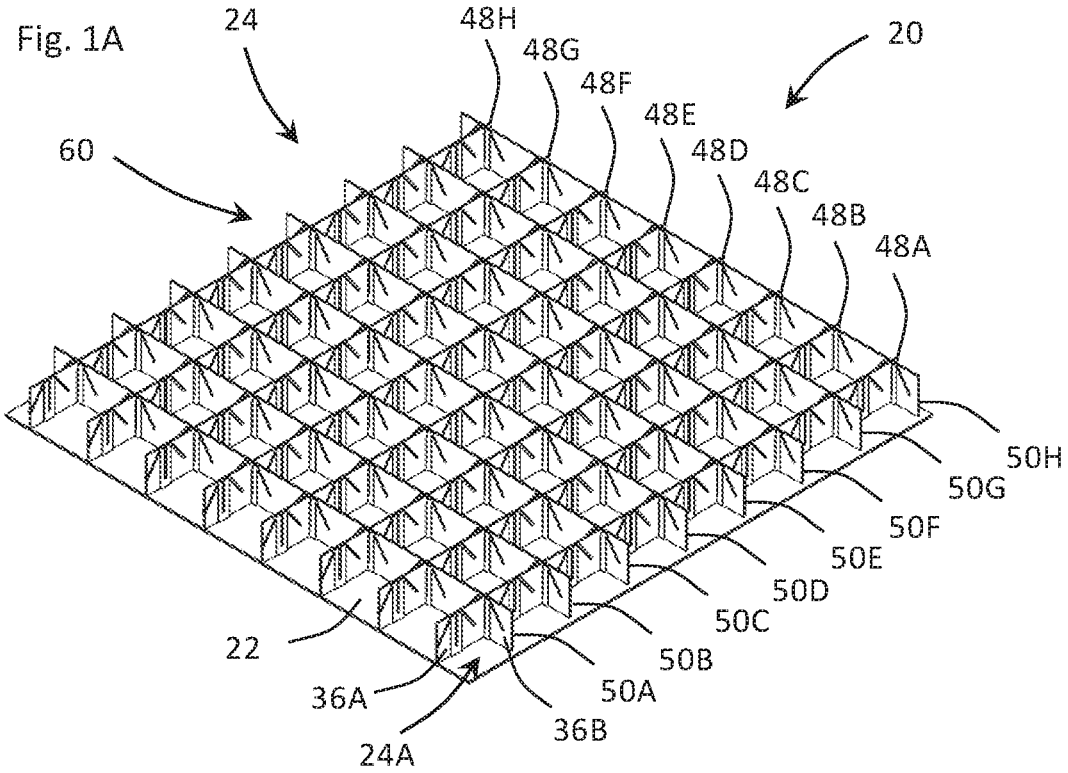
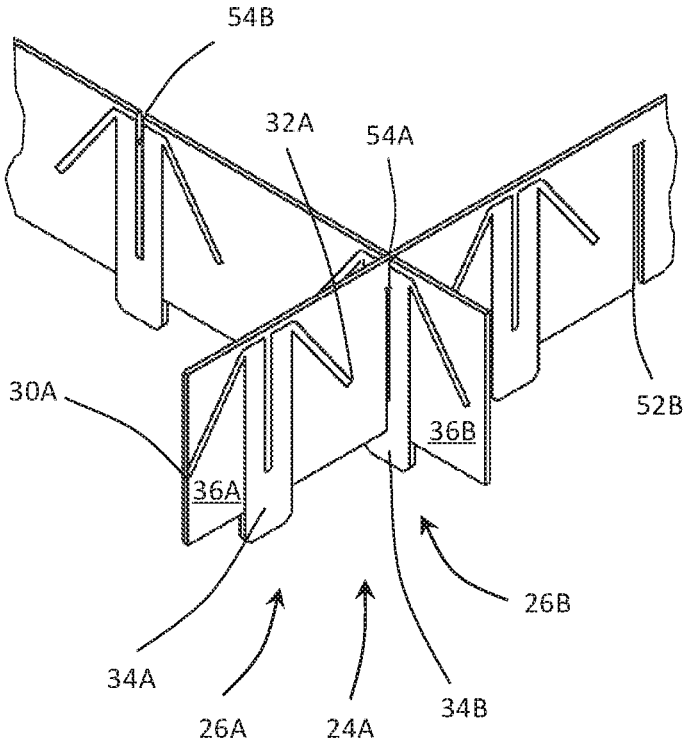
Fig. 1B

ARRAY ANTENNA WITH DUAL POLARIZATION ELEMENTS

FIELD OF THE INVENTION

The invention relates to an array antenna with dual polarization elements.

BACKGROUND OF THE INVENTION

An array antenna (sometimes referred to as "an antenna array") includes multiple antennas that cooperatively function as a single antenna. Each of the multiple antennas that form the array antenna is frequently referred to as an element. One type of array antenna includes elements that are capable of processing whatever portion of a signal has a vertical polarization, whatever portion of a signal has a horizontal polarization, and/or an elliptically polarized signal when coupled with the appropriate controlling electronics. This type of antenna is frequently referred to as a dual polarization array antenna or an array antenna with dual polarization elements. In such an array antenna, each element includes a first antenna that is capable of processing whatever portion of a signal has a vertical polarization and a second antenna that is capable of processing whatever portion of a signal has a horizontal polarization. The first and second antennas are capable of being used together to process an elliptically/circularly polarized signal. The first antenna and second antenna of an element can be considered sub-elements of an element. Further, the sub-element that is capable of processing whatever portion of a signal that has a vertical polarization can be referred to as a vertically polarized sub-element. Likewise, the sub-element that is capable of processing whatever portion of a signal has a horizontal polarization can be referred to as a horizontally polarized sub-element. Array antennas with dual polarization are also capable, when coupled with appropriate control electronics, of being used to create a beam that can be steered or scanned in different directions.

SUMMARY OF THE INVENTION

An array antenna with dual polarization elements is provided that collectively addresses a number of shortcomings that have been identified with respect to known array antennas with dual polarization elements. One of the identified shortcomings associated with some of the known array antennas with dual polarization is significant cross-polarization or x-pol. To elaborate, even though the horizontally and vertically polarized sub-elements in such an array antenna primarily and respectively process horizontally and vertically polarized signals, the horizontally polarized sub-element will have some adverse effect on the operation of the vertically polarized sub-element and the vertically polarized sub-element will have some adverse effect on the horizontally polarized sub-element. These effects are known as cross-polarization or x-pol effects. Significant cross-polarization is undesirable. A second shortcoming that has been identified is the limited scan range associated some of the array antennas with dual polarized elements. More specifically, some of these array antennas have structural characteristics that result in signal patterns with a main beam and grating lobes (i.e., significant lobes on each side of the main lobe) when a relatively small scan angle is exceeded. The presence of a main beam and grating lobes in such situations is undesirable. For instance, in a radar application, the presence of a main lobe and a grating lobe can make it difficult, if not impossible, to determine the direction in which an object detected by the radar is situated, i.e., whether the object is situated in the direction of the main beam or in the direction of a grating lobe. As such, an array antenna with these structural characteristics is limited to operating within a relatively small scan angle range in which ambiguities associated with having a signal pattern with a main beam and grating lobe are avoided. Another identified shortcoming is that certain structural characteristics of some of these array antennas with dual polarized elements renders the manufacturing or fabricating of the antennas difficult, time consuming, and/or expensive.

An array antenna with dual polarization elements is provided that exhibits relatively low cross-polarization, is capable of scanning over a relatively large range, and is also relatively easy to manufacture. The array antenna includes a ground plane and at least two elements situated on one side of the ground plane. Each of the elements comprises two sub-elements with one of the sub-elements adapted to process whatever portion of a signal is vertically polarized and the other sub-element adapted to process whatever portion of a signal is horizontally polarized. The sub-element that is adapted to process whatever portion of a signal that is vertically polarized is frequently referred to hereinafter as a vertically polarized sub-element. Likewise, the sub-element that is adapted to process whatever portion of a signal that is horizontally polarized is frequently referred to hereinafter a horizontally polarized sub-element. The two elements are capable of being coupled with control circuitry that allows the array antenna to be steered or scanned. As such, the array antenna is capable of being used as a phased array antenna. The two sub-elements of each element can also be coupled with control circuitry that allows for the selective processing of whatever portion of a signal is horizontally polarized, whatever portion of a signal is vertically polarized, or an elliptical/circularly polarized signal. Consequently, the array antenna can also be characterized as an array antenna with dual polarization elements. Characteristic of each of the two sub-elements associated with an element is: (a) a radiator structure that extends between a pair of terminal ends and a feed structure that is located in-between the pair of terminal ends and divides the radiator structure into two radiator portions, (b) in operation, an isolation plane that is located between the pair of terminal ends of the radiator structure, and (c) that the sub-element lies in and/or on a planar structure that is perpendicular to the ground plane. The isolation plane is a plane that is defined by a collection of points with each point receiving a signal of equal amplitude but opposite phase (i.e., a phase difference of 180°) from each of the two radiator portions of the sub-element. The two sub-elements of an element have a positional relationship to one another characterized by the planar member associated with the first sub-element being perpendicular to the planar member associated with the second sub-element. As such, the radiator structures and feed structures associated with the two sub-elements are also perpendicular to one another. Further, the radiator structure associated with the first sub-element lies in the isolation plane of the second sub-element and the planar member associated with the second sub-element intersects a plane defined by the planar member associated with the first sub-element. As such, each of the elements can be characterized as having a "t" shape or a "T" shape. The two elements also have a specific relationship to one another characterized by the planar members associated with the first sub-elements of each of the two elements being coplanar and the planar members associated with the second sub-elements of each of the two elements being parallel to, but not coplanar with, one another. As such, the two elements form a pair of stacked t/T's. In a particular embodiment, each of the elements has a "loose" T-shape in which the horizontal portion of the T-shape is separated from the vertical portion of the T-shape.

In another embodiment, the array antenna includes a third element that, like the first and second elements, has two sub-elements with one of the sub-elements adapted to process whatever portion of a signal has a vertical polarization and the other sub-element adapted to process whatever portion of a signal has a horizontal polarization. Also like the first and second elements, the two sub-elements each: (a) have a radiator structure that extends between a pair of terminal ends and a feed structure located in-between the pair of terminal ends and divides the radiator structure into two radiator portions, (b) have, in operation, an isolation plane that is located between the pair of terminal ends, and (c) lies in and/or on a planar structure that is perpendicular to the ground plane. The two sub-elements of the third element have a positional relationship to one another that, like the first and second elements, can be characterized as having a "t" shape or "T" shape. The third element has a particular positional relationship to the first and second elements. Namely, the first planar member of the third element is parallel to the first planar members of the first and second elements. In one embodiment, the second planar member of the third element is coplanar with the second planar member of the first element. In other words, the first planar members of the first and second elements are coplanar and the second planar members of the first and third elements are coplanar. As such, the array antenna, if expanded to include a fourth element stacked on the third element just as the second element is stacked on the fourth element, has a rectangular lattice.

In yet another embodiment, the second planar member of the third element is positioned to lie in the isolation plane of the first sub-element of the first element. To elaborate, the t-shape of an element results in a longer portion of the first sub-element being positioned on one side of the second sub-element. If the longer portion of the first sub-element of the third element is on the same side of the second sub-element of the third element as the longer portion of the first sub-element of the first element is on the side of the second sub-element of the first element and the array is expanded to include a fourth element that is stacked on the third element (just as the second element is stacked on the first element), the antenna array has a triangular lattice. Characteristic of this particular triangular lattice is that the stack formed by the first and second elements is identical to the stack formed by the third and fourth elements but the stacks are shifted relative to one another by an amount equal to the distance between the second sub-element and the first isolation plane of any one of the elements.

In another embodiment, the longer portion of the first sub-element of the third element is on the opposite side of the second sub-element of the third element as the longer portion of the first sub-element of the first element is on the side of the second sub-element of the first element and the array is expanded to include a fourth element that is identical to the third element and stacked on the third element, the antenna has a triangular lattice. Characteristic of this particular lattice is that the stacked formed by the third and fourth elements is identical to the stack formed by the first and second elements but flipped 180° and shifted by the distance between the second sub-element and the first isolation plane of any one of the elements.

BRIEF DESCRIPTION OF THE DRAWINGS

FIG. 1A-1F illustrate an embodiment of an array antenna with multiple, dual polarization elements provided by intersecting circuit boards that each support multiple sub-elements;

DETAILED DESCRIPTION

With reference to FIGS. 1A-1F, a first embodiment of an array antenna 20 (hereinafter "array antenna 20") is described that is relatively easy to manufacture and, in operation, exhibits relatively low cross-polarization and provides the ability to scan through a relatively large scan angle before encountering grating lobes problems. Generally, the array antenna 20 includes a planar reflector or ground plane 22 and an array 24 of sixty-four elements 24A that are disposed on one side of the planar reflector 22.

With reference to FIG. 1B, each element 24A includes two sub-elements 26A, 26B, that are each adapted to process a linearly polarized portion of a signal. Further, the two sub-elements 26A, 26B, are positioned so as to be substantially perpendicular to one another. As such, one of the two sub-elements can be characterized as being adapted for the processing whatever portion of a signal has a vertical polarization and the other sub-element can be characterized as being adapted for the processing of whatever portion of a signal has a horizontal polarization. It should be appreciated that the terms vertically polarized and horizontally polarized are not necessarily meant to be interpreted as implying that the sub-elements 26A, 26B, are positioned relative to a particular external frame of reference but rather that the first sub-element 26A and a second sub-element 26B are each adapted to process the portion of a signal that has one of a vertical and horizontal polarization and the sub-elements 26A, 26B, are disposed substantially perpendicular to one another.

Figure 1D:
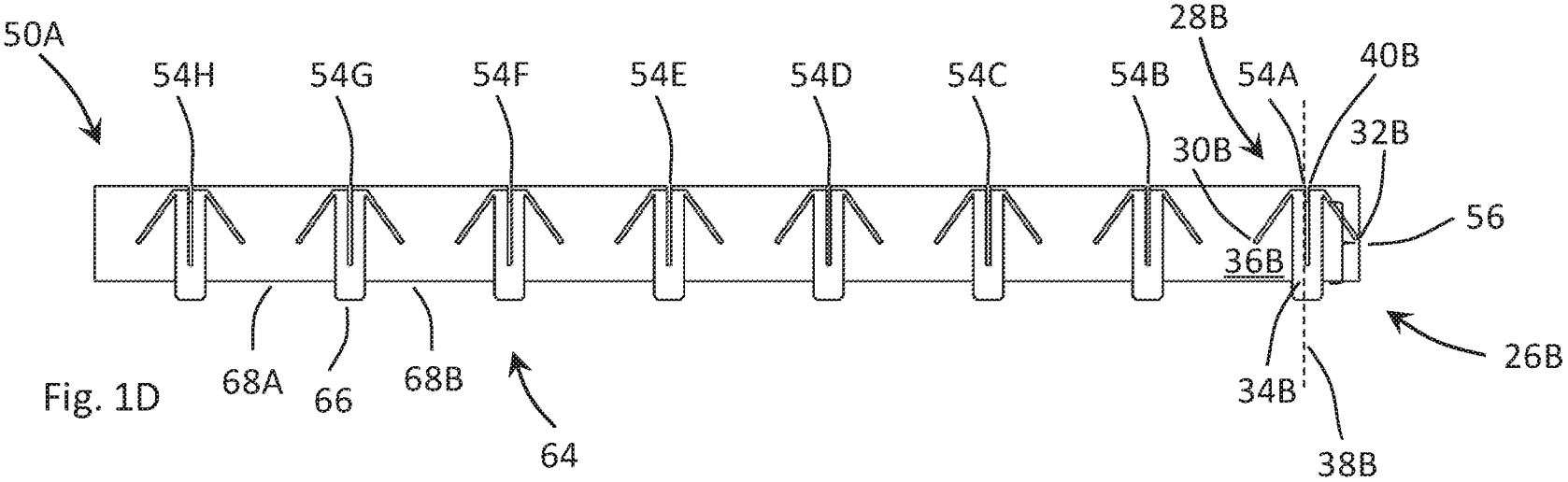
Figure 1C:
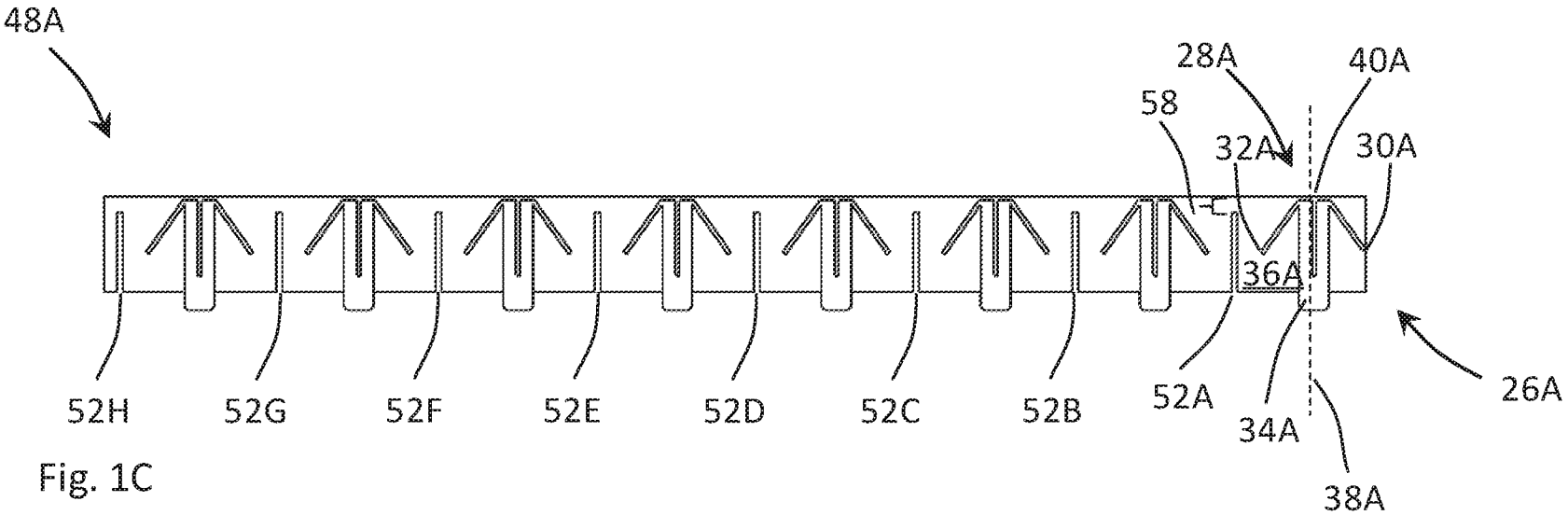

With reference to FIGS. 1B-1D, the first sub-element 26A is a first dipole antenna with a radiator structure 28A that extends between terminal ends 30A, 32A, and a balanced feed structure 34A that splits the radiator structure 28A into two, equal length sections and serves to provide a signal from a transmitter/transceiver to the radiator structure 28A and/or convey a signal received by the radiator structure 28A to a receiver/transceiver. The first sub-element 26A lies in and/or on a planar member 36A that is disposed substantially perpendicular to the planar reflector 22. In operation, the first sub-element 26A exhibits an isolation plane 38A, i.e., a plane defined by a collection of points with each point receiving a signal of equal amplitude but opposite phase (i.e., a phase difference of 180°) from each of the two radiator portions of the sub-element. In this embodiment, the first isolation plane 38A is perpendicular to the planar member 36A and passes through a mid-point 40A between the terminal ends 30A, 32A.

The second sub-element 26B is a second dipole antenna that is substantially identical to the first sub-element 26A. As such, the second dipole antenna includes a radiator structure 28B that extends between terminal ends 30B, 32B, and a balanced feed structure 34B that splits the radiator structure 28B into two, equal length sections and serves to provide a signal from a transmitter/transceiver to the radiator structure 28B and/or convey a signal received by the radiator structure 28B to a receiver/transceiver. The second sub-element 26B lies in and/or on a planar member 36B that is disposed substantially perpendicular to the planar reflector 22. In operation, the second sub-element 26B exhibits an isolation plane 38B. In this embodiment, the isolation plane 38B is perpendicular to the planar member 36B and passes through a mid-point 40B between the terminal ends 30B, 32B.

The first and second dipole antennas of the first and second sub-elements 26A, 26B can be implemented in a number of manners. Among these implementations are the establishment of a dipole antenna: (a) on the surface of a planar member, (b) between the substantially parallel exterior surfaces of a planar member, (c) inlaid in a planar member such that the dipole has an exterior surface that is substantially coplanar with the adjacent exterior surface of the planar member, and (d) such that portions of the dipole antenna are located on opposite parallel surfaces of a planar member and plated via holes or similar structures that pass through the planar member connect the portions disposed on the opposite parallel surfaces. Characteristic of each of these particular implementations, as well as other implementations known to those skilled in the art, is that the dipole antenna has a planar characteristic and is established in and/or on the planar member.

The planar members 36A, 36B, are substantially perpendicular to one another. As such, the radiator structures 28A, 28B, are also substantially perpendicular to one another. Further, the planar member 36A and the radiator structure 28A of the first sub-element 26A substantially lie in the isolation plane 38B of the second sub-element 26B. As such, the positional relationship of the radiator structures 28A, 28B of the first and second sub-elements 26A, 26B, can be characterized as T-shaped. Further, the planar member 36B of the second sub-element 26B intersects a plane that includes the first planar member 36A at a location that is not between the terminal ends 30A, 32A of the radiator structure 28A of the first sub-element 26A and spaced from the first terminal end 32A of the first sub-element 26A. As such, the positional relationship of the radiator structures 28A, 28B of the first and second sub-elements 26A, 26B, can be characterized as a "loose T-shape" in which the cross-member of the T-shape is separated from the upright member of the T-shape.

Having described one of the elements 24A of the array antenna 20, the positional relationship of two of the elements 24A in each of the "vertical" and "horizontal" directions is described. With reference FIG. 1E, the positional relationship of a first element 44A and a second element 44B in the vertical (or horizontal) direction is described. The first element 44A has a first sub-element 26A' that lies in and/or on a planar member 36A' and a second sub-element 26B' that lies in and/or on a planar member 363. The second element 44B has a first sub-element 26A" that lies in and/or on a planar member 36A" and a second sub-element 26B" that lies in and/or on a planar member 36B". The planar member 36A' of the first element 44A is coplanar with planar member 36A" of the second element 44B. As such, the planar member 363 of the first element 44A is substantially parallel to, but separated from, the planar member 36B" of the second element 44B. The two elements 44A, 44B, are capable of being used to scan in the vertical (or horizontal) direction. The positional relationship of the two elements 44A, 44B, can be characterized as a stacked-Ts or stacked, loose-Ts.

Figure 1E:
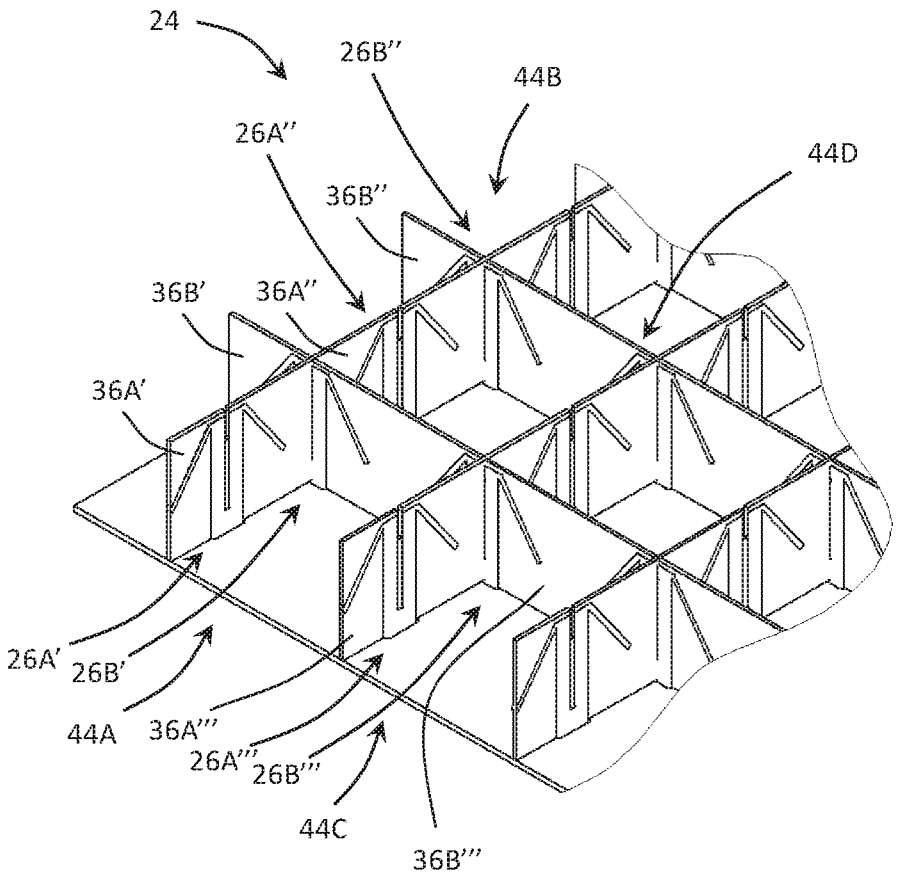
Figure 1F:
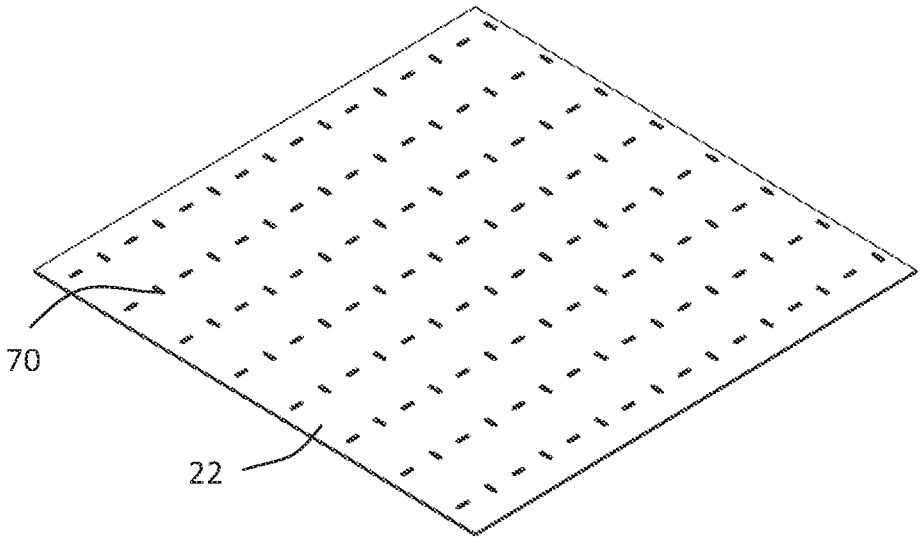

With continuing reference to FIG. 1E, the positional relationship of the first element 44A and a third element 44C in the horizontal (or vertical) direction is described. The third element 44C has a first sub-element 26A'" that lies in and/or on a planar member 36A'" and a second sub-element 26B'" that lies in and/or on a planar member 36B'". The planar member 36A' of the first element 44A is substantially parallel to, but separated from, the planar member 36A'" of the third element 44C. Further, the planar member 363 of the first element 44A is substantially coplanar with planar member 36B'" of the third element 44C. The two elements 44A, 44C, are capable of being used to scan in the horizontal (or vertical) direction. The positional relationship of the two elements 44A, 44C, can be characterized as side-by-side Ts or side-by-side, loose-Ts.

A fourth element 44D that has a stacked-Ts relationship with the third element 44C and in a side-by-side Ts relationship with second element 44B is sufficient to identify the elements 44A-44D as being positioned in a rectangular lattice, i.e., lines extending between corresponding points of the elements 44A-44D define a rectangle.

With reference to FIG. 1A, the array antenna 20 has sixty-four (64) elements 24A that are realized using: (a)

eight, printed circuit boards 48A-48H that each support eight, first sub-elements 26A that are substantially identical to one another and to the first sub-elements 26A on each of the other printed circuit boards (b) eight, printed circuit boards 50A-50H that each support eight, second sub-elements 26B that are substantially identical to one another and to the second sub-elements 26B on each of the other printed circuit boards. Further, the first sub-elements 26A associated with each of the eight, printed circuit boards 48A-48H are substantially identical to the second sub-elements 26B associated with each of the eight, printed circuit boards 50A-50H. Additionally, the distance between adjacent pairs of first sub-elements 26A on all of the printed circuit boards 48A-48H is substantially the same. The distance between adjacent pairs of second sub-elements 26B on all of the printed circuit boards 50A-50H is also substantially the same and substantially equal to the distance between adjacent pairs of first sub-elements 26A on all of the printed circuit boards 48A-48H. As such, the array antenna 20 has a square lattice, i.e., a form of a rectangular lattice. If the spacing between adjacent pairs of sub-elements 26B on all of the printed circuit boards 50A-50H is substantially the same but different than the distance between adjacent pairs of first sub-elements 26A on all of the printed circuit boards 48A-48H, a rectangular lattice is produced that is not a square lattice. In such a rectangular lattice, the adjacent sub-elements that are more closely spaced will be able to scan over a greater range before encountering grating lobes than whichever of the sub-elements are less closely spaced, which may be desirable or unavoidable in some applications. With reference to FIGS. 1C and 1D, the circuit boards 48A and 50A are further described with the understanding that circuit boards 48B-48H are substantially identical to circuit board 48A and circuit boards 50B-50H are substantially identical to circuit board 50A. The circuit board 48A includes eight, long notches 52A-52H that respectively receive a portion of circuit boards 50A-50H. Each of the notches 52A-52H having a width that is just slightly larger than the width of the portion of the circuit board 50A-50H received by the notch. The circuit board 50A includes eight, short notches 54A-54H that respectively receive a portion of circuit boards 48A-48H. Each of the notches 54A-54H having a width that is just slightly larger than the width of the portion of the circuit board 48A-48H received by the notch. Notably, each of the short notches 54A-54H is respectively located in the isolation plane of the sub-element 26B with which the notch is associated. More specifically, the long notches 52A-52H associated with the circuit board 48A respectively receive the long portion 56 of each of the circuit boards 50A-50H that is adjacent to the corresponding one of the short notches 54A-54H. Similarly, the short notches 54A-54H associated with circuit board 50A respectively receive the short portion 58 of each of the circuit boards 48A-48H that is adjacent to the corresponding one of the long notches 52A-52H. In this manner, the eight, circuit boards 48A-48H engage the eight, circuit boards 50A-50H to establish a rectangular lattice 60 (more specifically, a square lattice) that supports sixty-four elements 24A. These sixty-four elements are each composed of two sub-elements, such as sub-elements 26A, 26B. As such, the elements of array antenna 20 can be positioned closer to one another than array antennas that employ elements that are each composed of four sub-elements, such as those shown in U.S. Pat. Nos. 6,650,291 and 9,806,432. The ability to position the elements of array antenna 20 closer to one another allows the antenna to scan over a significantly greater range than array antennas that employ elements composed of four sub-elements before encountering a grating lobe problem. Further, because the radiator of the first sub-element 26A is substantially perpendicular to the radiator of the second sub-element 26B and positioned in the isolation plane of the second sub-element 26B, the elements 24A in the array 24 if employed individually, collectively as a group of sixty-four elements, or as a group that is a subset of the sixty-four elements exhibits a low cross-polarization. In one embodiment, a cross-polarization of about −40 dB was achieved.

While this notch engagement structure renders the circuit boards 48A-48H substantially parallel to one another, the circuit boards 50A-50H substantially parallel to one another, and the circuit boards 48A-48H substantially perpendicular to each of circuit boards 50A-50H, the lattice 60 is susceptible to skewing such that the circuit boards can rotate relative to one another so that the rectangular lattice 60 becomes a parallelogram lattice. To prevent this from occurring, the bottom edge of each of the eight, circuit boards 48A-48H and each of the eight, circuit boards 50A-50H is crenellated with a portion of each of the balanced feed structures associated with each of the sub-elements borne by each of these boards extending beyond the other portions of the bottom edge and being of sufficient length to extend through a corresponding slot in the planar reflector 22 a sufficient distance to be connected to other balanced feed and/or control circuitry used in conjunction with the array antenna 20. With reference to FIG. 1D, this feature of the circuit board 50A is described with respect to one sub-element 26B with the understanding that this feature is substantially the same with respect to each sub-element 26B in each of the other circuit boards 48B-48H and each sub-element 26A in circuit boards 50A-50H. Circuit board 50A has a bottom edge 64 that has portion 66 (a tab) of each balanced feed structure 34B associated with each of the sub-elements 26B supported by the circuit board 50A that extends beyond the colinear portions 68A-68B of the bottom edge 64 that are adjacent to the portion 66 of each balanced feed structure. Further, each portion 66 of the bottom edge 64 is of sufficient length to extend through a corresponding slot 70 that passes through the planar reflector 22 and beyond. As such, the bottom edge 64 can be characterized as a crenellated or square-wave, bottom edge 64. The portion of the each of the portions 66 that extends beyond the bottom planar surface of the planar reflector 22 is engaged to a balanced feed structure that completes the balanced feed structure associated with the circuit board and/or control circuitry that is used in conjunction with the array antenna 20 during operation of the antenna. The engagement of each of the circuit boards 48A-48H and 50A-50H to the planar reflector 22 via the crenellated bottom edges of the cards and slots established in the planar reflector prevents the circuit boards from skewing. Additionally, this engagement structure facilitates the establishment of a perpendicular relationship between the planar reflector 22 and each of the circuit boards 48A-48H and 50A-50H. Moreover, if there is sufficient friction between the portions 66 and the surface of the planar reflector 22 that defines the slots, the engagement structure may fix the position of the circuit boards 48A-48H and 50A-50H relative to the planar reflector 22. If there is insufficient friction, the balanced feed structure and/or control circuit that engages the portion of each of the portions 66 that extends beyond the bottom planar surface of the reflector 22 can be used to fix the position of the circuit boards 48A-48H and 50A-50H relative to the planar reflector 22. Alternatively, a glue or cement can be used to fix the position of the circuit boards 48A-48H and 50A-50H relative to the planar reflector 22. It should be appreciated that other structures known to those skilled in the art can be employed to prevent skewing of the circuit boards 48A-48H and 50A-50H and fix the position of the circuit boards relative to the planar reflector 22. For instance, a frame that extends around the outer periphery of the circuit boards can be constructed that engages the planar reflector 22 and has slots for receiving the end edges of the circuit boards. After the slots receive the end edges of the circuit boards, a cap structure that extends over the open end of each slot can be employed to prevent the circuit boards from being displaced away from the planar reflector 22.

The bottom edges 64 of printed circuit boards 48A-48H are substantially identical to the bottom edges 64 of the printed circuit boards 50A-50H. In this regard, the portions 66 of the bottom edge that extend beyond the colinear portions 68A-68B of the bottom edge 64 that bracket each portion 66 support at least a portion of the balanced feed structure 34A/34B associated with each of the sub-elements on each of the printed circuit boards 48A-48H and 50A-50H. Since the sub-elements associated each of the printed circuit boards 48A-48H and printed circuit boards 50A-50H are substantially identical to one another and the circuit boards 48A-48H and 50A-50H are substantially perpendicular to the planar reflector 22, the sub-elements associated with the printed circuit boards 48A-48H and 50A-50H lie in a plane, i.e., a collection of corresponding points associated with the sub-elements (e.g. the mid-points 40A or 40B between the ends of the radiator of each sub-element) substantially define a plane.

The top edges and lateral edges of the printed circuit boards 48A-48H and 50A-50H are substantially identical to one another. To elaborate, the top edge of each of the circuit boards 48A-48H and 50A-50H is linear, substantially parallel to the colinear portions 68A, 68B of the bottom edge 64, and substantially the same distance from the colinear portions 68A,68B for the entire length of the card. The lateral edges of each of the circuit boards 48A-48H and 50A-50H are linear, parallel to one another, and perpendicular to the colinear portions 68A, 68B of the bottom edge 64. Further, the distance between the lateral edges of all of the circuit board 48A-48H and 50A-50H is substantially the same.

It should be appreciated that the top edge of each of the circuit boards 48A-48H and 50A-50H could be non-linear or non-parallel to the colinear portions 68A, 68B, and that the top edge of one of the circuit boards could be different from the top of edge or another circuit board without any substantial effect on the operation of the resulting array antenna. Further, the lateral edges of each of the circuit boards 48A-48H and 50A-50H could be non-linear, non-parallel to one another, or non-perpendicular to the colinear portions 68A, 68B of the bottom edge, and that the distance between the lateral edges of one circuit board could be different from the distance between the lateral edges of another one of the circuit boards without any substantial effect on the operation of the resulting array antenna.

The manufacture of the array antenna 20 is individually and collectively facilitated by: (a) the establishment of sub-elements on planar structures that, in antenna array 20, are realized by using printed circuit board manufacturing techniques to realize the sub-elements established on each of the circuit boards 48A-48H and 50A-50H, (b) the separation of the feed structures associated with an element from one another, (c) notches in the circuit boards that are used to engage the circuit boards to one another, and (d) the use of the portions 66 of the circuit boards and slots 70 in the planar reflector 22 to position the circuit boards relative to one another and to the planar reflector 22.

Figure 2B:
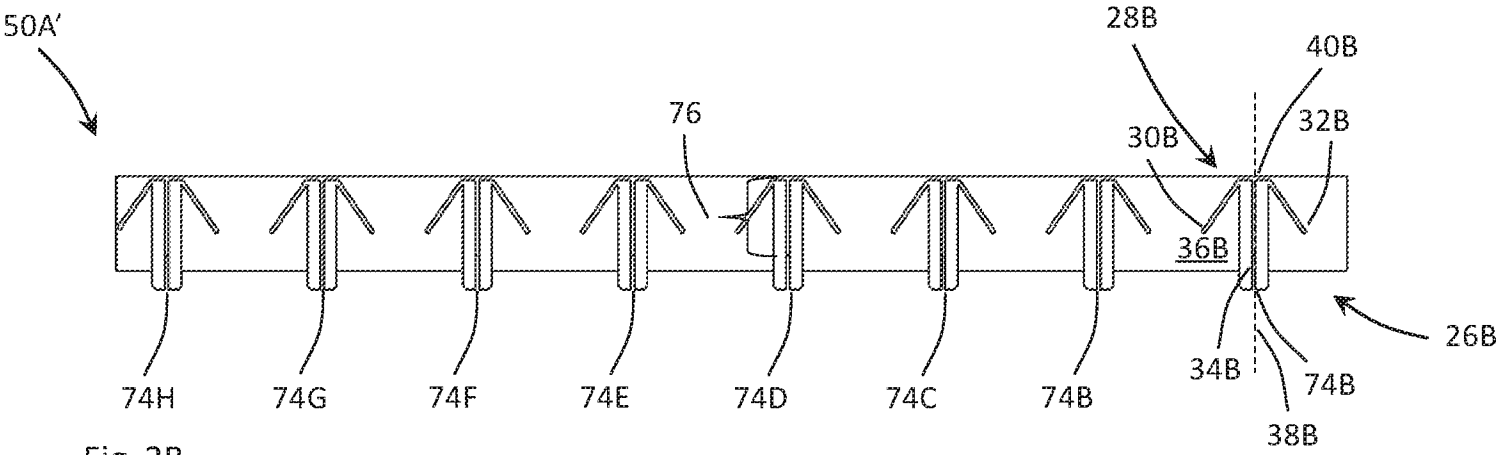
FIGS. 2A-2C respectively illustrate a first printed circuit board with dipole sub-elements, a second printed circuit board with dipole sub-elements, and a dual polarization element resulting from the union of the two circuit boards via an alternative notching structure.
Figure 2A:
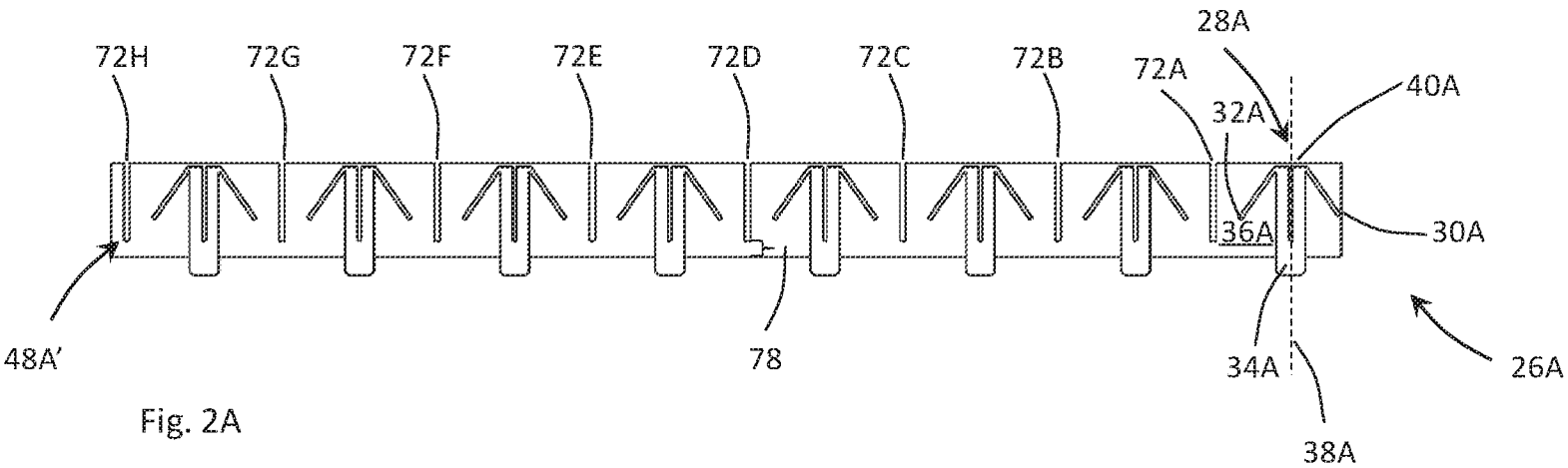
Figure 2C:
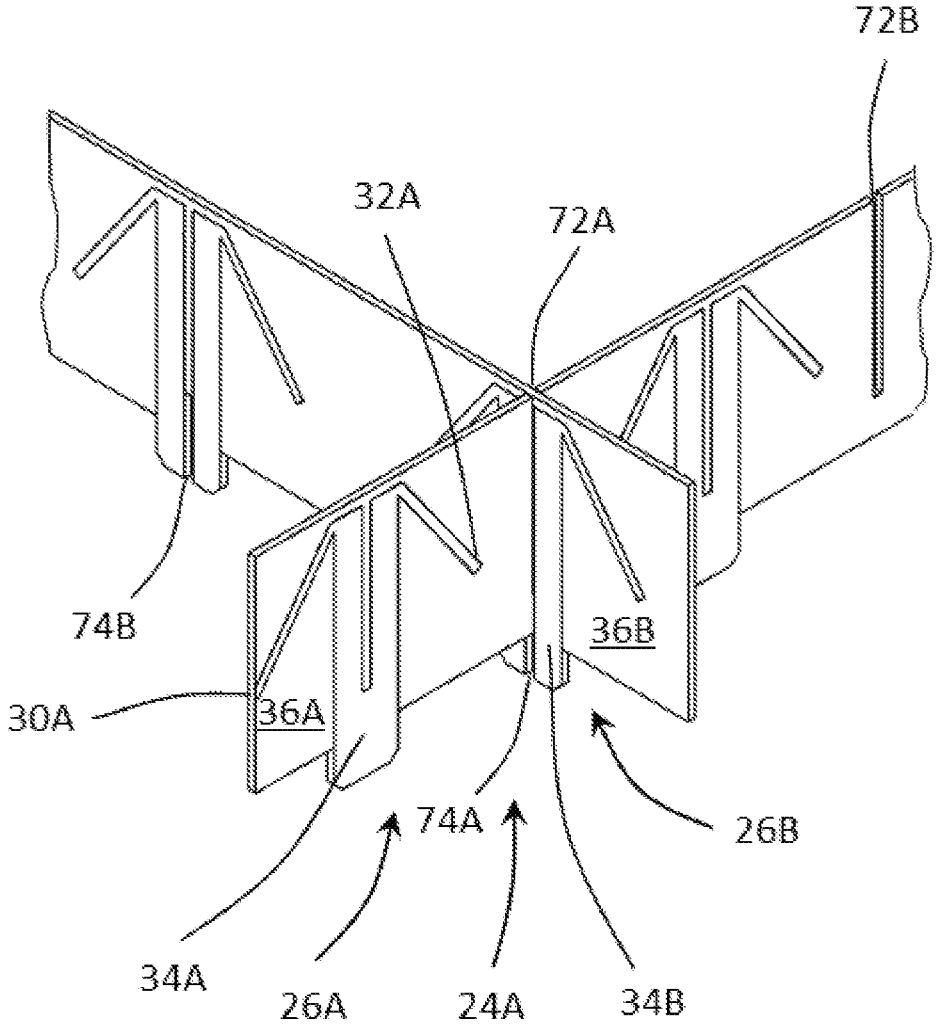

With reference to FIGS. 2A-2C, a different notching structure is described that results in the sub-elements of each element being positioned as shown in FIG. 2C. The different notching structure is described with respect to printed circuit boards 48A' and 50A', which are substantially identical to printed circuit boards 48A and 50A, except for the location and orientation of the notches that are used to join the printed circuit boards 48A' and 50A'. Further, any circuit boards disposed substantially parallel to circuit board 48A' in an array antenna would be substantially identical to circuit board 48A'. Likewise, any circuit boards disposed substantially parallel to circuit board 50A' in an array antenna would be substantially identical to circuit board 50A'. Features of circuit boards 48A' and 50A' that are respectively common to circuit boards 48A and 50A are accorded the same reference numbers and will not be further described.

The circuit board 48A' includes eight, long notches 72A-72H that respectively receive a portion of circuit board 50A' and portions of seven other circuit boards that are substantially identical to circuit board 50A'. The circuit board 50A' includes eight, short notches 74A-74H that respectively receive a portion of circuit board 48A' and portions of seven other circuit boards that are substantially identical to circuit board 48A'. More specifically, the long notches 72A-72H associated with the circuit board 48A' respectively receive a long portion 76 (only identified with respect to one of the sub-elements of circuit board 50A') of the circuit boards 50A' and long portions of seven other circuit boards that are substantially identical to circuit board 50A'. Similarly, the short notches 74A-74H associated with circuit board 50A' respectively receive a short portion 78 (only identified with respect to one of the sub-elements of circuit board 48A') of circuit board 48A' and short portions of seven other circuit boards that are substantially identical to circuit board 48A'.

Figure 3A:
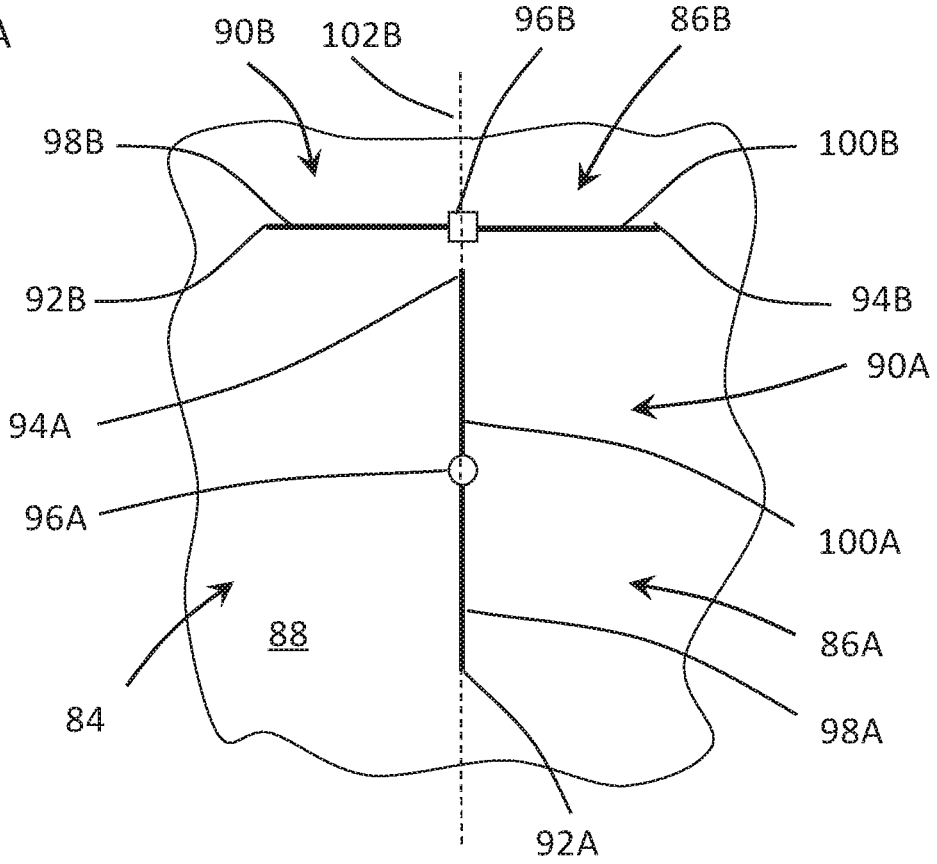
FIGS. 3A and 3B are schematic, plan views that illustrate the range of positions that a second sub-element can take relative to a first sub-element for an element used in an array antenna.

There is a range of orientations of the first sub-element to the second sub-element of an element employed in an array antenna. One end of this range of orientations can be characterized as a "loose T-shape" and the other end of the range can be characterized as having a "t-shape." FIG. 3A is a schematic, plan view of an element 84 with the loose T-shape that is characteristic of one end of the range. The element 84 includes first and second sub-elements 86A, 86B, that each lie in a plane that is perpendicular to a planar reflector or ground plane 88. The first sub-element 86A includes a radiator 90A that extends from a first terminal end 92A to a second terminal end 94A. A balanced feed structure 96A is disposed between the first and second terminal ends 92A, 94A of the radiator 90A and divides the radiator into two sections 98A, 100A. The second sub-element 86B includes a radiator 90B that extends from a first terminal end 92B to a second terminal end 94B. A balanced feed structure 96B is disposed between the first and second terminal ends 92B, 94B of the radiator 90B and divides the radiator into two sections 98B, 100B. The first and second sub-elements 86A, 86B, are disposed perpendicular to one another. Further, the radiator 90A of the first sub-element 86A is disposed in the isolation plane 102B of the second sub-element 86B. Notably, the second sub-element 86B is spaced from the second terminal end 94A of the first sub-element 86A. Hence, the element 90 has a loose T-shape. The elements 24A of the embodiment of the array antenna 20 shown in FIGS. 1A-1F each have a loose T-shape.

Figure 3B:
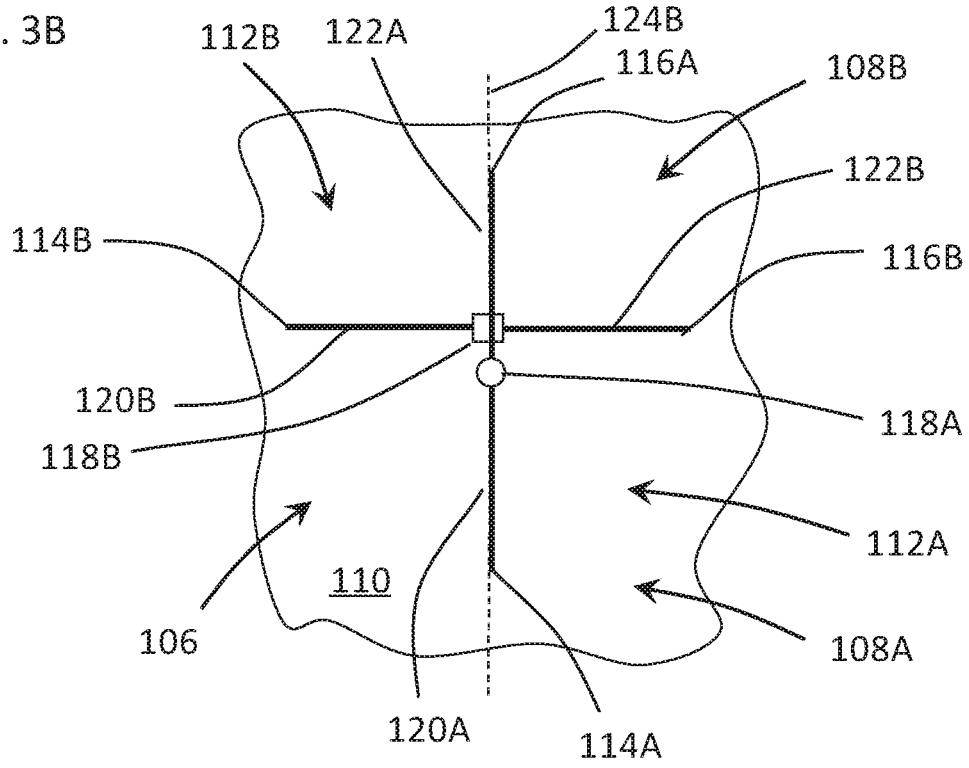

FIG. 3B is a schematic, plan view of an element 106 with the t-shape that is characteristic of the other end of the range. The element 106 includes first and second sub-elements 108A, 108B, that each lie in a plane that is perpendicular to a planar reflector or ground plane 110. The first sub-element 108A includes a radiator 112A that extends from a first terminal end 114A to a second terminal end 116A. A balanced feed structure 118A is disposed between the first and second terminal ends 114A, 116A of the radiator 112A and divides the radiator into two sections 120A, 122A. The second sub-element 108B includes a radiator 112B that extends from a first terminal end 114B to a second terminal end 116B. A balanced feed structure 118B is disposed between the first and second terminal ends 114B, 116B of the radiator 112B and divides the radiator into two sections 120B, 122B. The first and second sub-elements 108A, 108B, are disposed perpendicular to one another. Further, the radiator 112A of the first sub-element 108A is disposed in the isolation plane 124B of the second sub-element 108B. Notably, the second sub-element 108B is located adjacent to the balanced feed structure 118A.

The second sub-element 108B can be positioned anywhere between the two limits of the range, namely, from immediately adjacent to the balanced feed structure 118A to the position of second sub-element 86B illustrated in FIG. 3A. For example, the second sub-element can be positioned so as to intersect the terminal end of the first sub-element (e.g., 116A in FIG. 3B). In such an embodiment, the positional relationship of the first and second sub-elements can be characterized as a "perfect T-Shape."

Figure 4B:
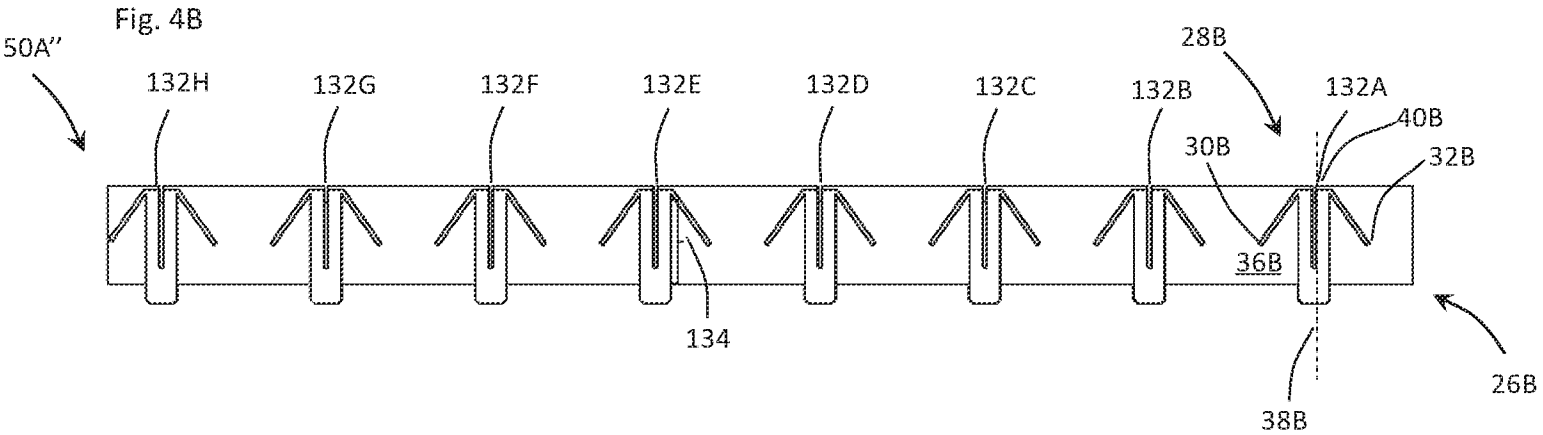
FIGS. 4A-4C respectively illustrate a first printed circuit board with dipole sub-elements and long notches, a second printed circuit board with dipole sub-elements and short notches, and a dual polarization element resulting from the union of the two circuit boards and having a t-shape.
Figure 4A:
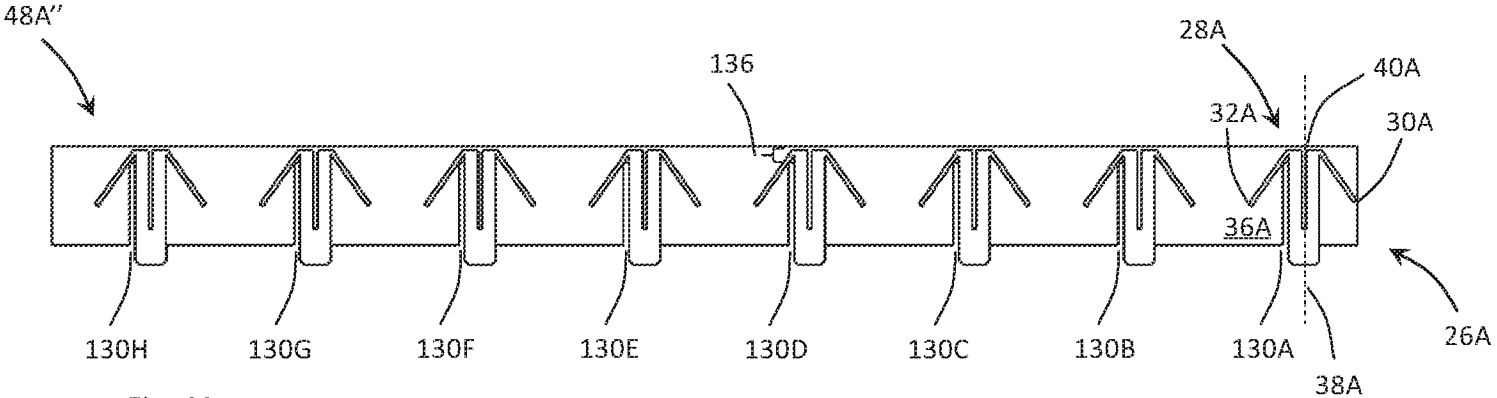
Figure 4C:
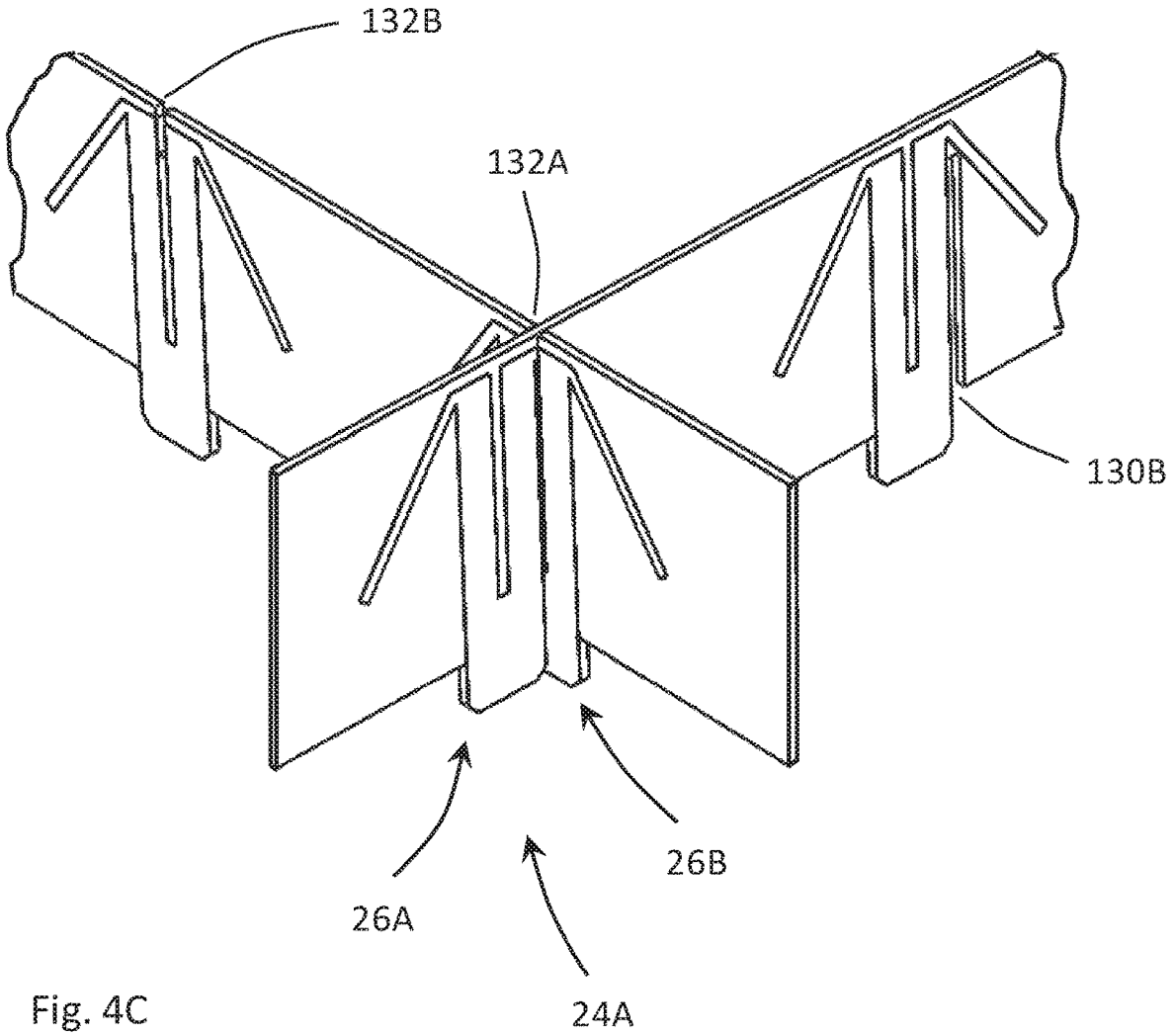

With reference to FIGS. 4A-4C, a notching structure for positioning a second sub-element at a location that intersects one of the two sections of the radiator is described. The notching structure is described with respect to printed circuit boards 48A" and 50A", which are substantially identical to printed circuit boards 48A and 50A, except for the location and orientation of the notches that are used to join the printed circuit boards 48A" and 50A". Further, any circuit boards disposed substantially parallel to circuit board 48A" in an array antenna would be substantially identical to circuit board 48A". Likewise, any circuit boards disposed substantially parallel to circuit board 50A" in an array antenna would be substantially identical to circuit board 50A". Features of circuit boards 48A" and 50A" that are respectively common to circuit boards 48A and 50A are accorded the same reference numbers and will not be further described.

The circuit board 48A" includes eight, long notches 130A-130H that respectively receive a portion of circuit board 50A" and portions of seven other circuit boards that are substantially identical to circuit board 50A". The circuit board 50A" includes eight, short notches 132A-132H that respectively receive a portion of circuit board 48A" and a portion of seven other circuit boards that are substantially identical to circuit board 48A". More specifically, the long notches 130A-130H associated with the circuit board 48A" respectively receive a long portion 134 (only identified with respect to one of the sub-elements of circuit board 50A") of the circuit board 50A" and the long portions associated with seven other circuit boards that are substantially identical to circuit board 50A". Similarly, the short notches 132A-132H associated with circuit board 50A" respectively receive a short portion 136 (only identified with respect to one of the sub-elements of circuit board 48A") of the circuit board 48A" and the short portions associated with seven other circuit boards that are substantially identical to circuit board 48A".

Figure 5B:
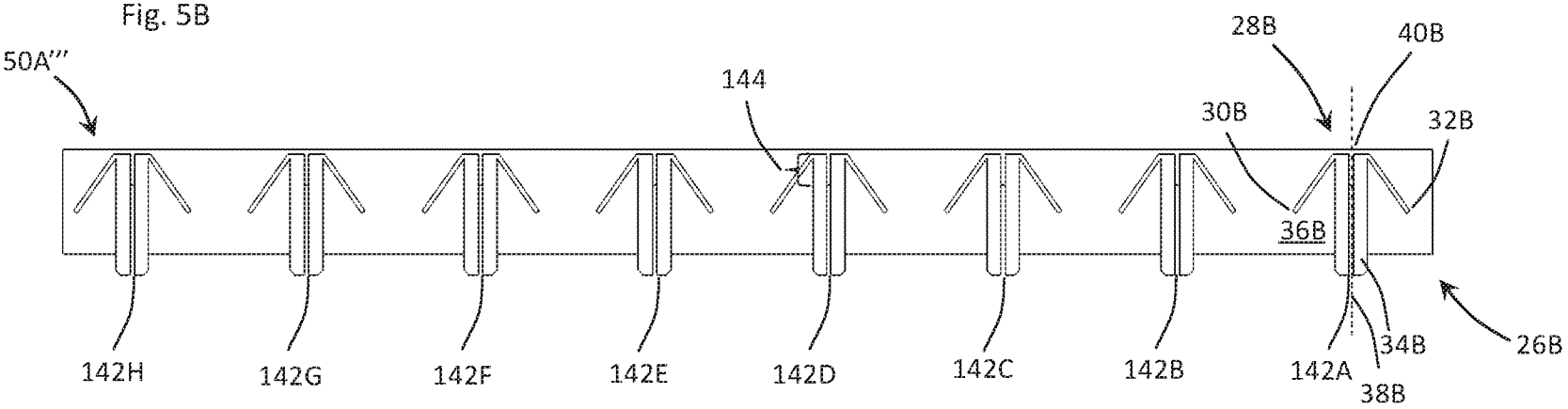
FIGS. 5A-5C respectively illustrate a first printed circuit board with dipole sub-elements and short notches, a second printed circuit board with dipole sub-elements and long notches, and a dual polarization element resulting from the union of the two circuit boards and having a t-shape.
Figure 5A:
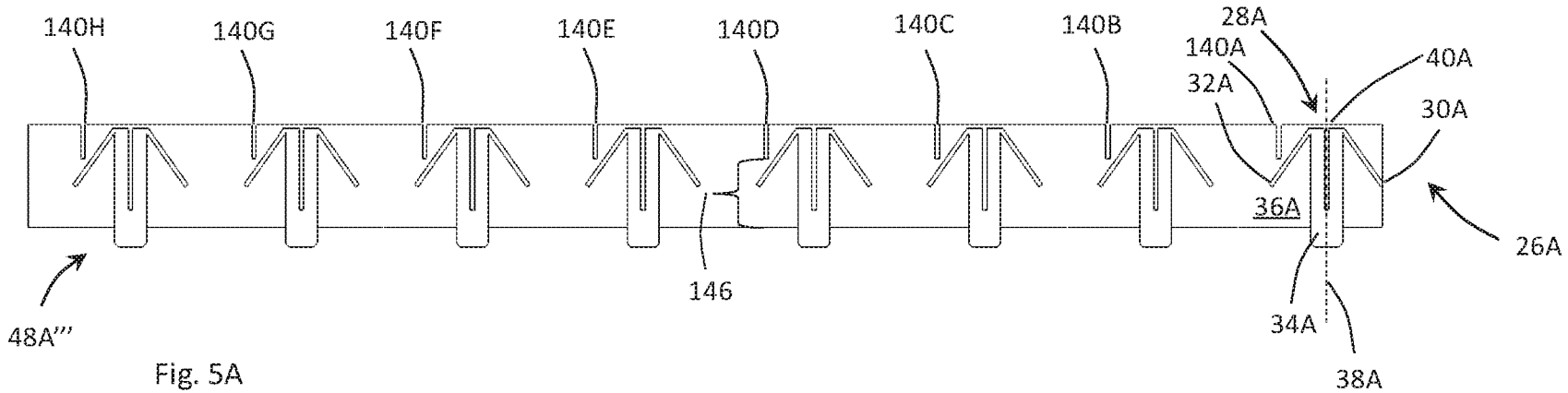
Figure 5C:
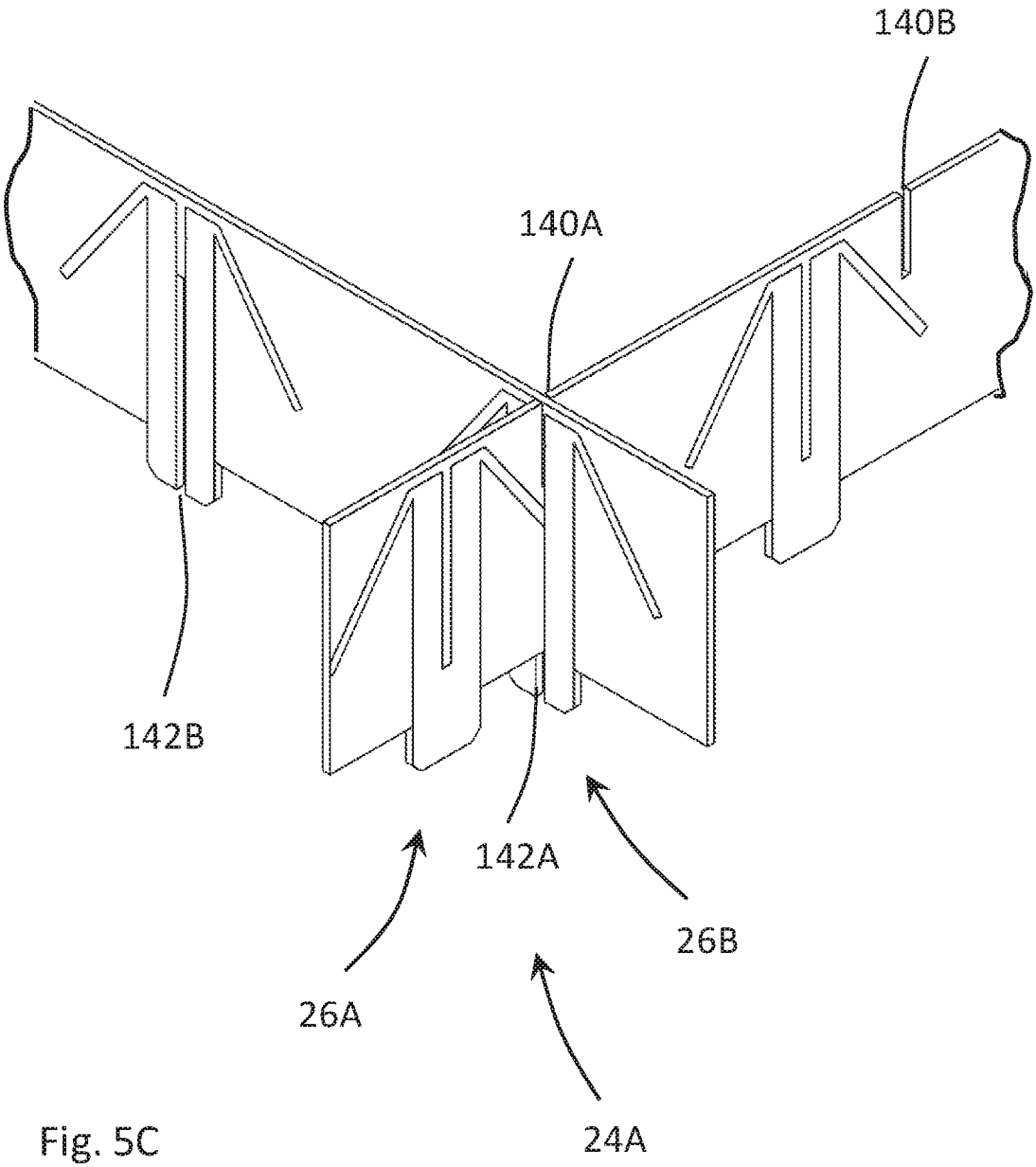

With reference to FIGS. 5A-5C, another notching structure for positioning a second sub-element at a location that intersects one of the two sections of the radiator. The notching structure is described with respect to printed circuit boards 48A'" and 50A'", which are substantially identical to printed circuit boards 48A and 50A except for the location and orientation of the notches that are used to join the printed circuit boards 48A'" and 50A'". Further, any circuit boards disposed substantially parallel to circuit board 48A'" in an array antenna would be substantially identical to circuit board 48A". Likewise, any circuit boards disposed substantially parallel to circuit board 50A'" in an array antenna would be substantially identical to circuit board 50A'". Features of circuit boards 48A'" and 50A'" that are respectively common to circuit boards 48A and 50A are accorded the same reference numbers and will not be further described.

The circuit board 48A'" includes eight, short notches 140A-140H that respectively receive a portion of circuit board 50A'" and seven other circuit boards that are substantially identical to circuit board 50A'". The circuit board 50A' includes eight, long notches 142A-142H that respectively receive a portion of circuit board 48A'" and seven other circuit boards that are substantially identical to circuit board 48A". More specifically, the short notches 140A-140H associated with the circuit board 48A'" respectively receive a short portion 144 (only identified with respect to one of the sub-elements of circuit board 50A") of circuit board 50A'" and short portions of seven other circuit boards that are substantially identical to circuit board 50A'". Similarly, the long notches 142A-142H associated with circuit board 50A'" respectively receive the long portion 146 (only identified with respect to one of the sub-elements of circuit board 48A") of circuit board 48A'" and seven other circuit boards that are substantially identical to circuit board 48A".

The antenna structure employed to realize each of the sub-elements in array antenna 20 is a sloping dipole with an arrowhead-shape. However, other types of antennas can be used to realize each of the sub-elements in array antenna 20. Characteristic of each such type of antenna is that the radiator has a planar characteristic that is capable of being embodied in and/or on a planar member (e.g., a printed circuit board), a balanced feed structure is employed to transmit and/or receive an electrical signal to/from the radiator, and the balanced feed structure divides the radiator structure into two sections that are substantially mirror images of one another relative to a plane that passes through the balanced feed structure and is perpendicular to the planar member. These types of antennas include, but are not limited to, a dipole other than a sloping dipole, a Vivaldi antenna, and a balanced antipodal Vivaldi antenna (BAVA). Further, the sub-elements and elements formed with each of these different types of antennas and the range of positions that the sub-elements can take with respect to one another can be schematically represented as shown in FIGS. 3A and 3B.

Figure 6B:
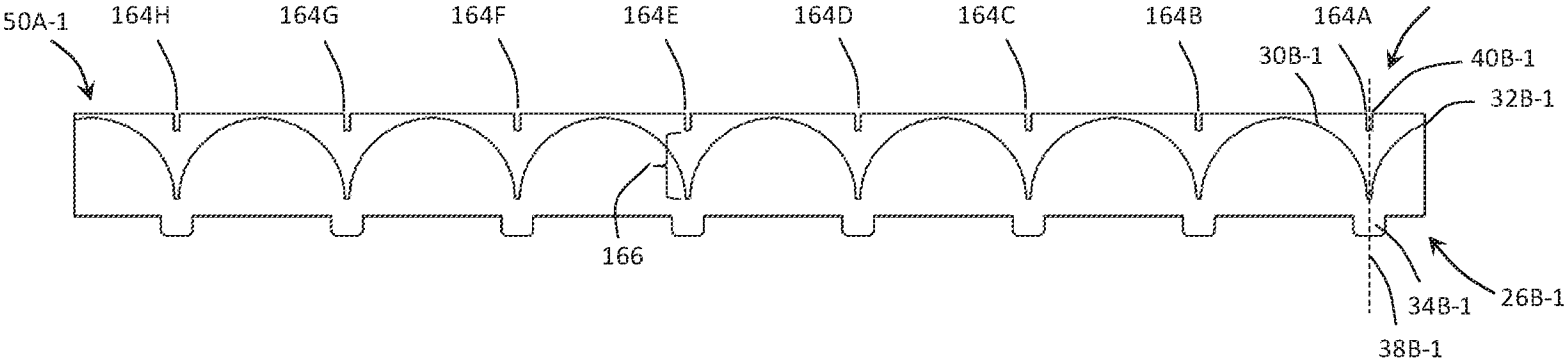
FIGS. 6A-6C respectively illustrate a first printed circuit board with Vivaldi sub-elements, a second printed circuit board with Vivaldi sub-elements, and a dual polarization element resulting from the union of the two circuit boards.
Figure 6A:
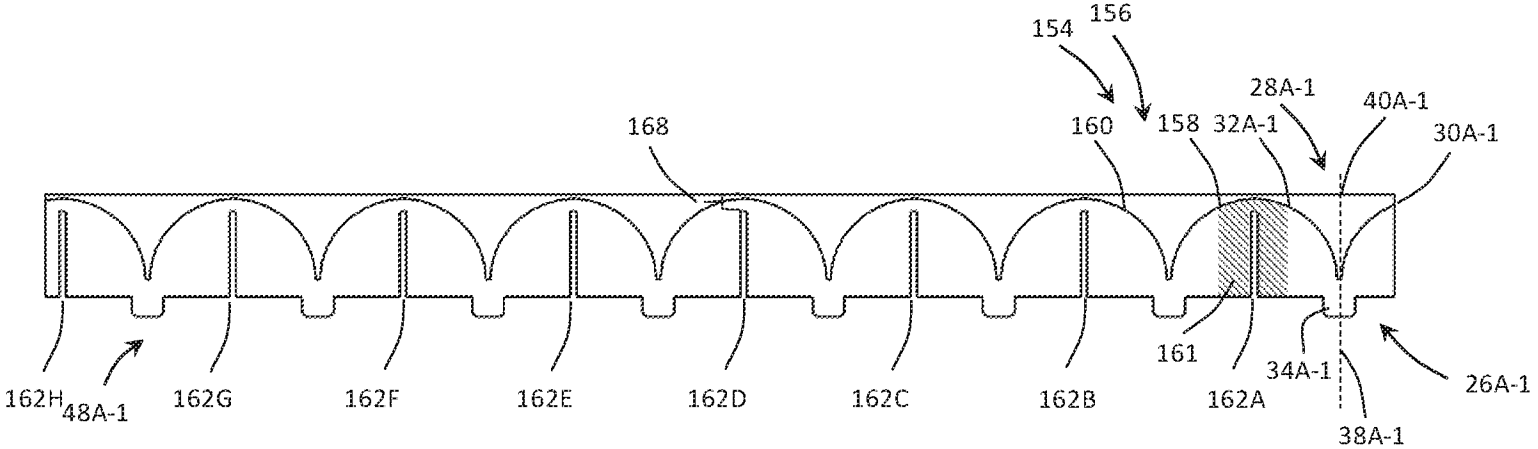
Figure 6C:
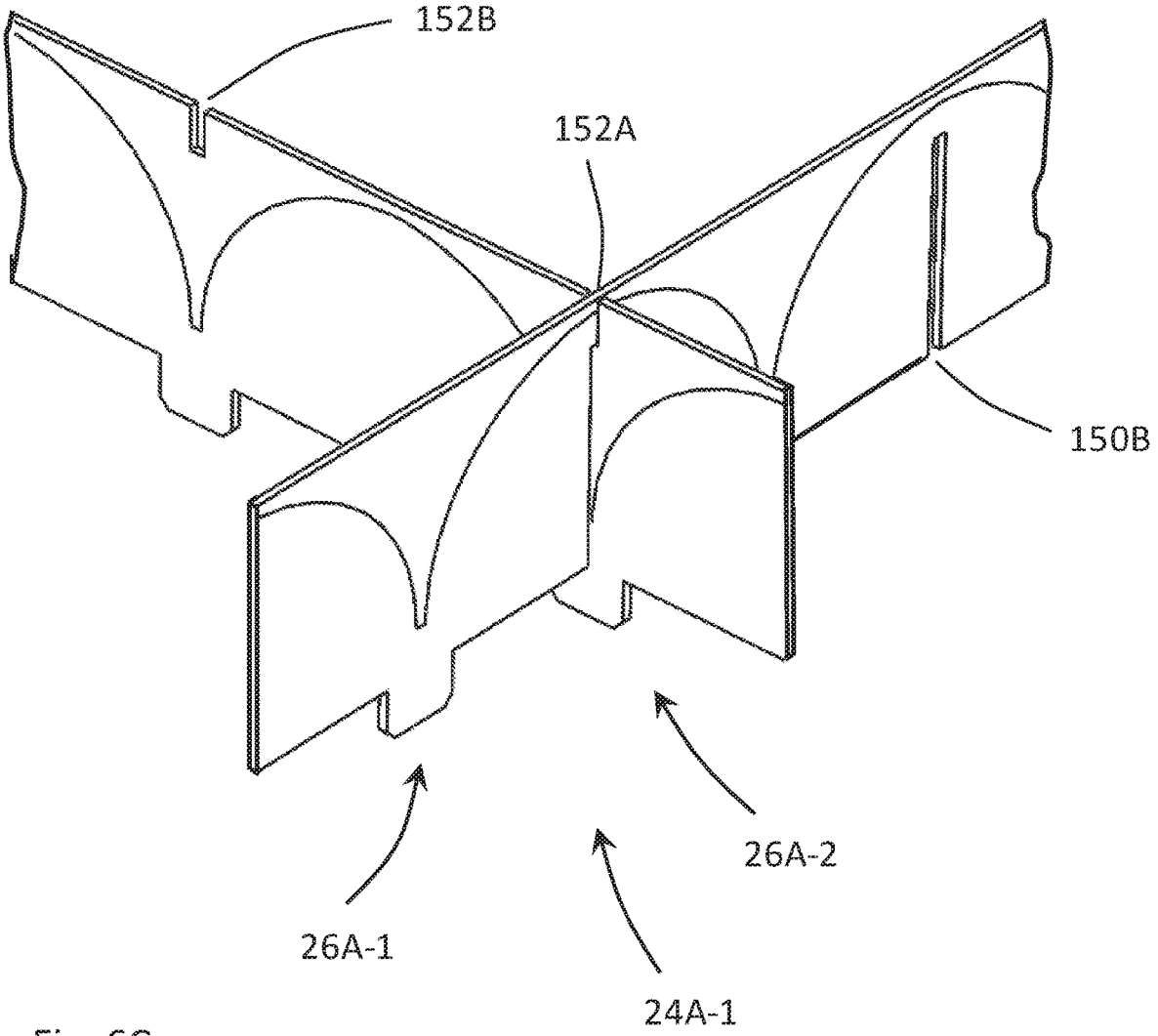

With reference to FIGS. 6A-6C, an embodiment of an array antenna employing sub-elements in the form of Vivaldi antennas is described. Just as with the array antenna 20, a comparable array antenna with sixty-four elements that employ Vivaldi antenna sub-elements (hereinafter Vivaldi sub-elements) can be realized using a first set of eight, printed circuit boards that each include eight, Vivaldi sub-elements with the printed circuit boards being substantially identical to one another and parallel to one another, a second set of eight, printed circuit boards that each includes eight, Vivaldi sub-elements and with the printed circuit boards being substantially identical to one another and parallel to one another, the first and second set of printed circuit boards being positioned substantially perpendicular to one another so as to form a rectangular lattice, and the first and second sets of printed circuit boards being positioned substantially perpendicular to a planar reflector or ground plane. As such, only one of the first set of printed circuit boards 48A-1, one of the second set of printed circuit boards 50A-1, and the notching structure used in establishing perpendicularity between the circuit board 48A-1 and the circuit board 50A-1 is described.

The circuit board 48A-1 supports Vivaldi sub-element 26A-1 that includes a radiator 28A-1 that extends from a first terminal end 30A-1 to a second terminal end 32A-1 and a balanced feed structure 34A-1 that divides the radiator 28A-1 into two sections. A second Vivaldi sub-element 154 that is located immediately adjacent to the Vivaldi sub-element 26A-1 includes a radiator 156 that extends from a first terminal end 158 to a second terminal end 160. Notably, a metallized area 161 (shaded) defined by the second terminal end 32A-1 of the Vivaldi sub-element 26A-1 and the first terminal end 158 of the Vivaldi sub-element 154 is not part of either Vivaldi sub-element 26A-1 or Vivaldi sub-element 154. A comparable metallization is located between immediately adjacent pairs of Vivaldi sub-elements associated with circuit boards 48A-1 and 50A-1. This metallization is included to avoid etching away metal in the preparation of the circuit board that does not affect the operation of the Vivaldi sub-elements. However, this metallization can be eliminated if needed or desired without affecting the operation of the Vivaldi sub-elements. The circuit board 48A-1 includes eight, long notches 162A-162H that respectively receive a portion of circuit board 50A-1 and a portion of seven other circuit boards that are substantially identical to circuit board 50A-1.

The circuit board 50A-1 supports a Vivaldi sub-element 26B-1 that includes a radiator 28B-1 that extends from a first terminal end 30B-1 to a second terminal end 32B-1 and a balanced feed structure 34B-1 that divides the radiator 28B-1 into two sections. As with circuit board 48A-1, the circuit board 50A-1 includes metallization between immediately adjacent pairs of Vivaldi sub-elements that is not part of either sub-element. The circuit board 50A-1 includes eight, short notches 164A-164H that respectively receive a portion of circuit board 48A-1 and a portion of seven other circuit boards that are substantially identical to circuit board 48A-1.

With reference to FIG. 6C, the engagement of the circuit board 48A-1 and the circuit board 50A-1 to establish element 24A-1 is described. To establish element 24A-1 (which is comparable to element 24A of FIG. 1A), the long notch 162A of circuit board 48A-1 receives a long portion 166 of circuit board 50A-1 (only identified with respect to one sub-element of circuit board 50A-1) that is adjacent to notch 164A of circuit board 50A-1 and the short notch 164A of circuit board 50A-1 receives a short portion 168 (only identified with respect to one sub-element of circuit board 48A-1) of circuit board 48A-1. The element 24A-1, due to the separation of immediately adjacent Vivaldi sub-elements 26A-1 and 154 on circuit board 48A-1, results in the element 24A-1 having a loose T-shape. It should be appreciated that a perfect T-shape can be realized by eliminating the metallized area 161 or moving the notch 162A towards the balanced feed 34A-1. Further, the second Vivaldi sub-element can be positioned as schematically shown in FIG. 3B to realize an element with a t-shape by moving the notch 162A towards the balanced feed 34A-1.

Figure 7:
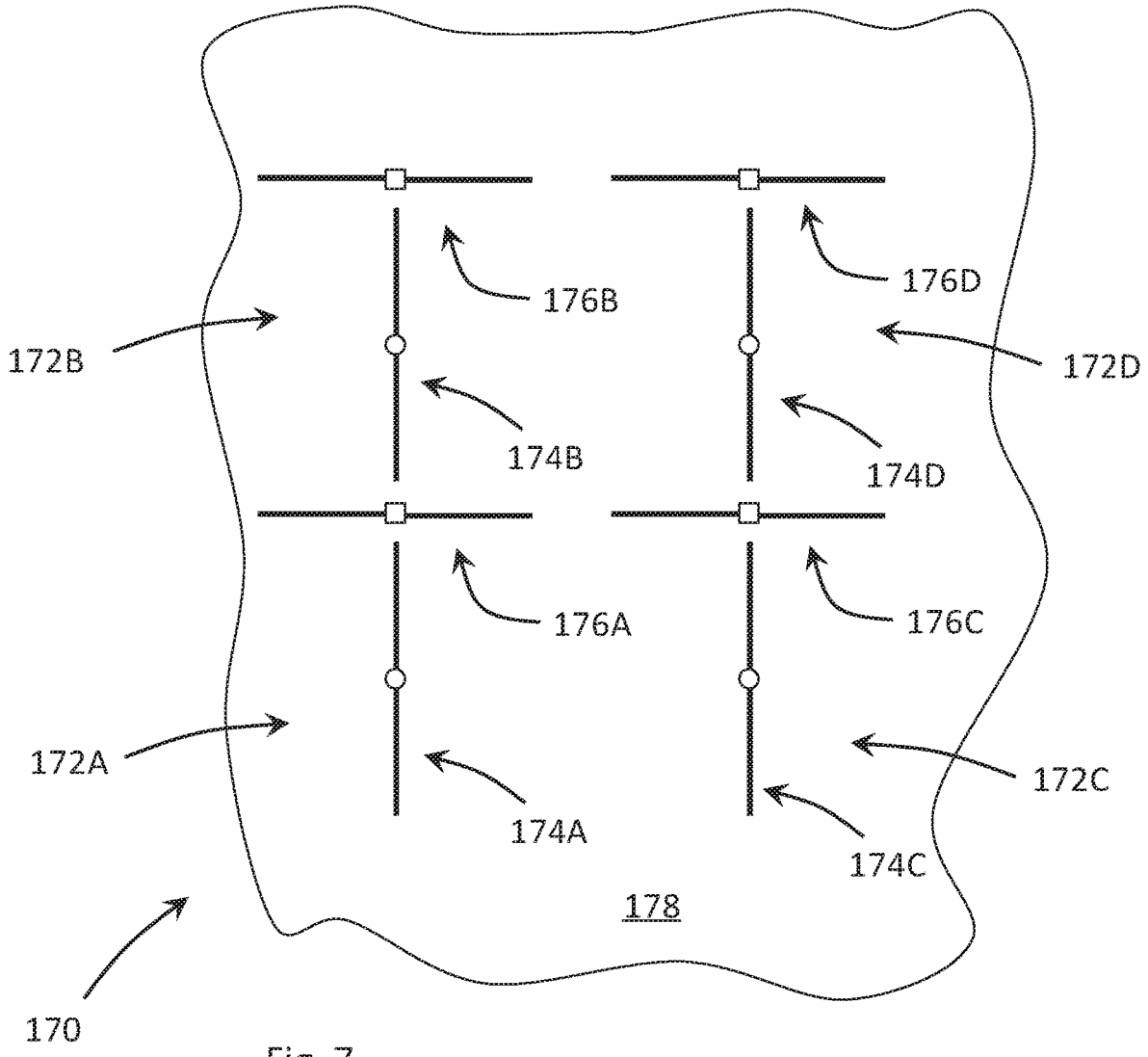
FIG. 7 is a schematic, plan view of an embodiment of an array antenna with dual polarization elements that has a rectangular lattice.

Characteristic of the array antenna 20 is that elements are disposed in a rectangular lattice. Other embodiments of an array antenna with dual polarization elements that have a triangular lattice and are relatively easy to manufacture, have low x-pol in operation, and are capable of having a large scan angle before encountering grating lobe issues are feasible. For comparison, FIG. 7 schematically illustrates an array antenna 170 that has a rectangular lattice. The array antenna 170 includes elements 172A-172D. Each of the elements 172A-172D respectively includes a first sub-element 174A-174D and a second sub-element 176A-176D. The sub-elements are all of the same type of antenna (e.g., sloping dipole, T-dipole, Vivaldi antenna, or a balanced antipodal Vivaldi antenna (BAVA). Further, each of the sub-elements 174A-174D and 176A-176D has a radiator that is capable of being embodied in and/or on a planar member (e.g., a printed circuit board), a balanced feed structure that is employed to transmit and/or receive an electrical signal to/from the radiator, and the balanced feed structure that divides the radiator structure into two sections that are substantially mirror images of one another relative to a plane that passes through the balanced feed structure and is perpendicular to the planar member. The planar members with which each of the sub-elements 174A-174D and 176A-176D is associated are disposed substantially perpendicular to a ground plane 178. The sub-elements 174A-174D and 176A-176D lie in a plane, i.e., a collection of corresponding points associated with the sub-elements substantially define a plane. With respect to each element 172A-172D, the radiator associated with each of the first sub-elements 174A-174D respectively lies in the isolation plane of the second sub-elements 176A-176D. Further, as to each element 172A-172D, the radiator associated with each of the first sub-elements 174A-174D is respectively perpendicular to the radiator associated with second sub-elements 176A-176D. The elements 172A, 172B have a stacked-T positional relationship, the elements 172C, 172D have a stacked-T positional relationship, the elements 172A, 172C have a side-by-side T positional relationship, and the elements 172B, 172D have a side-by-side T positional relationship.

Figure 8:
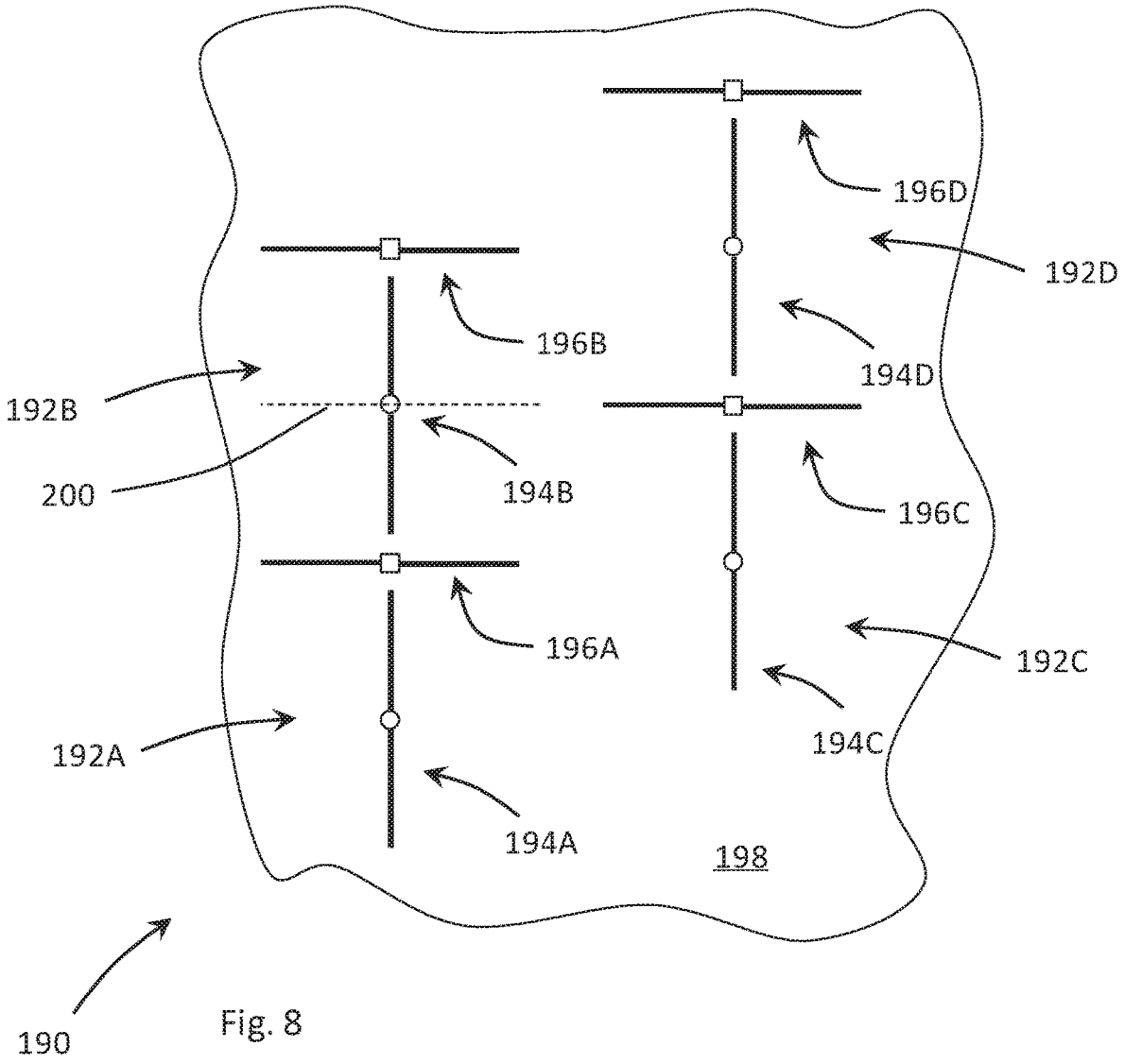
FIG. 8 is a schematic, plan view of an embodiment of an array antenna with dual polarization elements that has a triangular lattice.

With reference to FIG. 8, an embodiment of an array antenna with dual polarization elements that has a triangular lattice 190 (hereinafter array antenna 190) is described. The array antenna 190 includes elements 192A-192D. Each of the elements 192A-192D respectively includes a first sub-element 194A-194D and a second sub-element 196A-196D. The sub-elements are all of the same type of antenna. Further, each of the sub-elements 194A-194D and 196A-196D has a radiator that is capable of being embodied in and/or on a planar member (e.g., a printed circuit board), a balanced feed structure that is employed to transmit and/or receive an electrical signal to/from the radiator, and the balanced feed structure that divides the radiator structure into two sections that are substantially mirror images of one another relative to a plane that passes through the balanced feed structure and is perpendicular to the planar member. The planar members with which each of the sub-elements 194A-194D and 196A-196D is associated are disposed substantially perpendicular to a ground plane 198. The sub-elements 194A-194D and 196A-196D lie in a plane, i.e., a collection of corresponding points associated with the sub-elements substantially define a plane. With respect to each element 192A-192D, the radiator associated with each of the first sub-elements 194A-194D respectively lies in the isolation plane of the second sub-elements 196A-196D. Further, as to each element 192A-192D, the radiator associated with each of the first sub-elements 194A-194D is respectively perpendicular to the radiator associated with second sub-elements 196A-196D. Further, the elements 192A, 192B have a stacked-T positional relationship and the elements 192C, 192D have a stacked-T positional relationship. However, these two groups of stacked-T elements are offset with respect to one another such that the radiator associated with sub-element 196C lies in an isolation plane 200 of sub-element 194B. As such, the array antenna 190 has a triangular lattice. It is believed that array antenna 190 will exhibit an even better x-pol in operation than array antenna 170.

Figure 9:
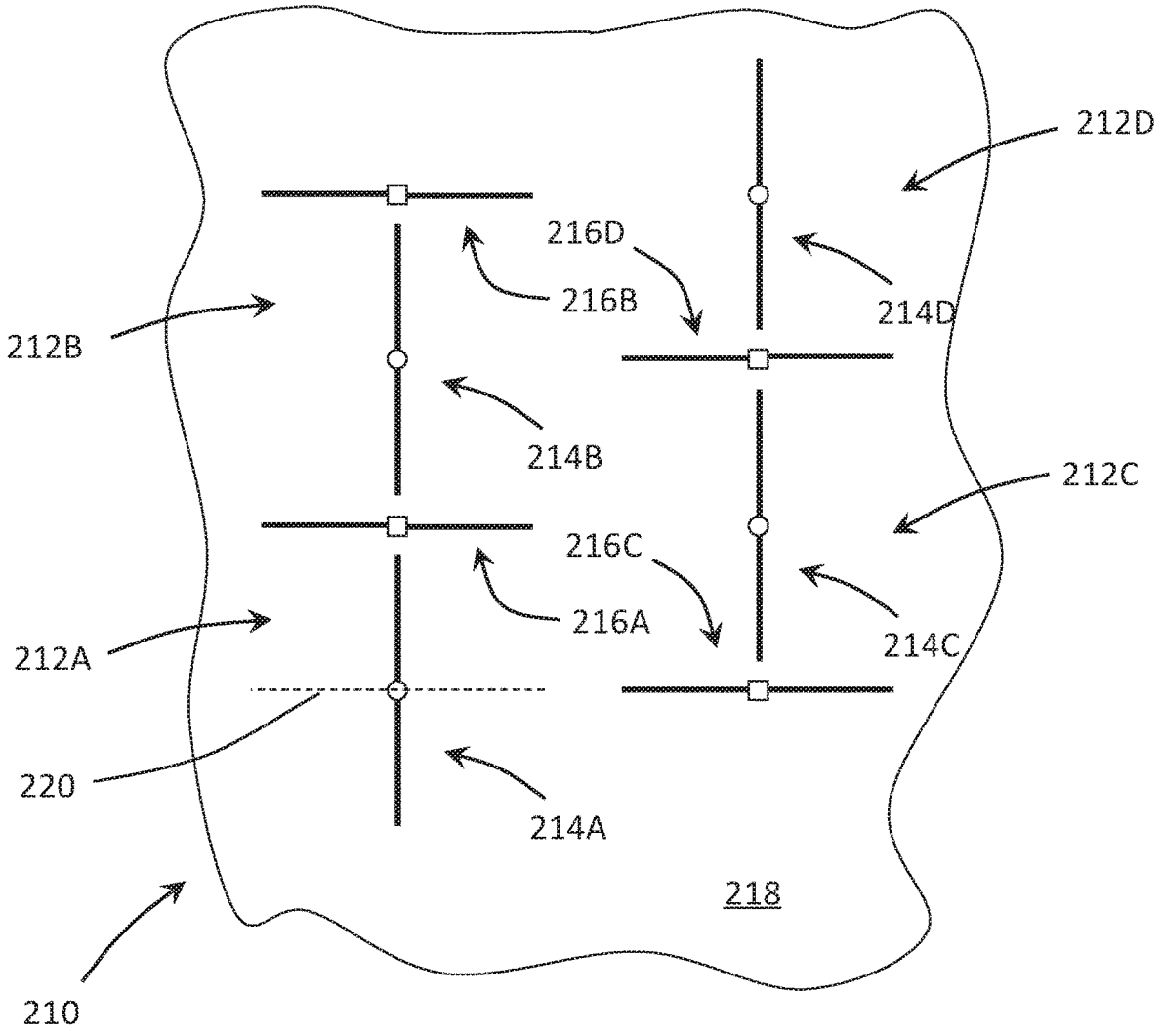
FIG. 9 is a schematic, plan view of another embodiment of an array antenna with dual polarization elements that has a triangular lattice.

With reference to FIG. 9, an embodiment of an array antenna with dual polarization elements that has a triangular lattice 210 (hereinafter array antenna 210) is described. The array antenna 210 includes elements 212A-212D. Each of the elements 212A-212D respectively includes a first sub-element 214A-214D and a second sub-element 216A-216D. The sub-elements are all of the same type of antenna. Further, each of the sub-elements 214A-214D and 216A-216D has a radiator that is capable of being embodied in and/or on a planar member (e.g., a circuit board), a balanced feed structure that is employed to transmit and/or receive an electrical signal to/from the radiator, and the balanced feed structure that divides the radiator structure into two sections that are substantially mirror images of one another relative to a plane that passes through the balanced feed structure and is perpendicular to the planar member. The planar members with which each of the sub-elements 214A-214D and 216A-216D is associated are disposed substantially perpendicular to a ground plane 218. The sub-elements 214A-214D and 216A-216D lie in a plane, i.e., a collection of corresponding points associated with the sub-elements substantially define a plane. With respect to each element 212A-212D, the radiator associated with each of the first sub-elements 214A-214D respectively lies in the isolation plane of the second sub-elements 216A-216D. Further, as to each element 212A-212D, the radiator associated with each of the first sub-elements 214A-214D is respectively perpendicular to the radiator associated with second sub-elements 216A-216D. Further, the elements 212A, 212B have a stacked-T positional relationship and the elements 212C, 212D have a stacked-T positional relationship. However, these two groups of stacked-T elements are offset and inverted with respect to one another such that the radiator associated with sub-element 216C lies in an isolation plane 220 of sub-element 214A and the first sub-element 214C of element 212C is on the opposite side of sub-element 216C from that which first sub-element 214A is on the side of sub-element 216A. As such, the array antenna 190 has a triangular lattice. It is believed that array antenna 210 will exhibit an even better x-pol in operation than array antenna 170.

Figure 10:
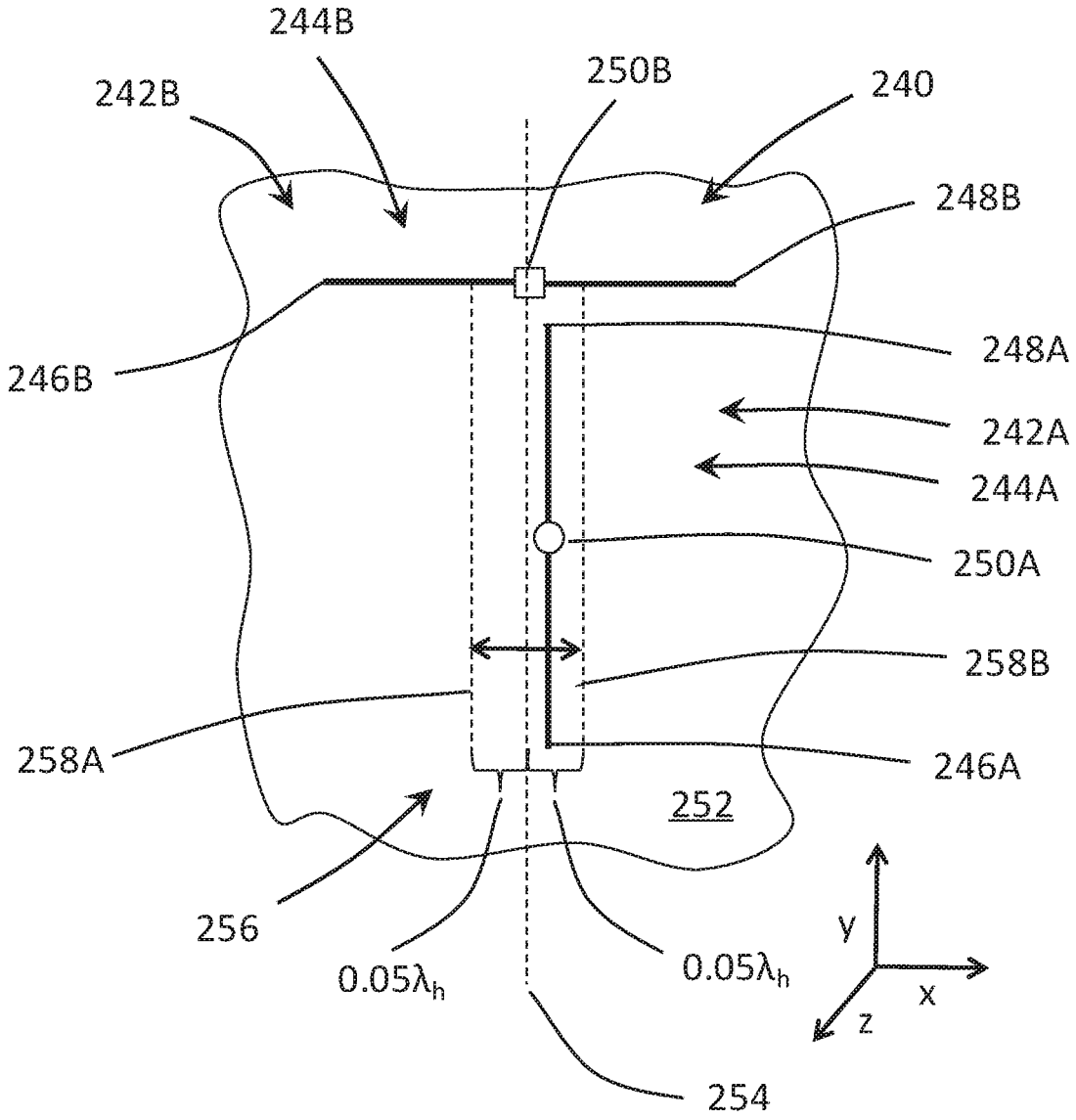
FIG. 10 is a schematic plan view of a "thin" isolation plane and a "thick" isolation plane associated with a first sub-element of an element of an array antenna, and the range over which a second sub-element of the element can be translated relative to the "thin" isolation plane and remain within the "thick" isolation plane.
Figure 11:
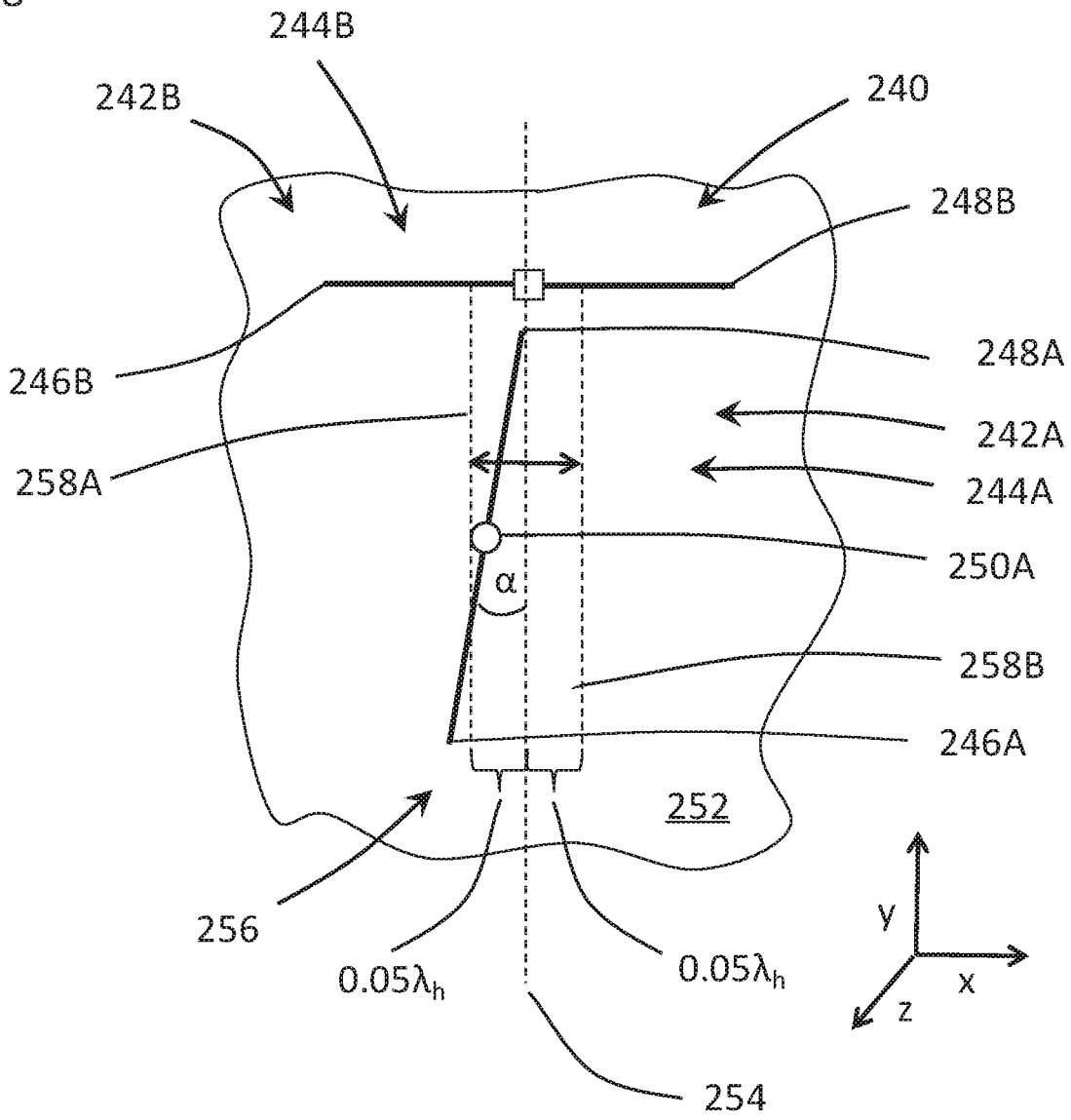
FIG. 11 is a schematic plan view of "thin" and "thick" isolation planes associated with a first sub-element of an element of an array antenna and the second sub-element both translated relative to the "thin" isolation plane and rotated about a z-axis.
Figure 12:
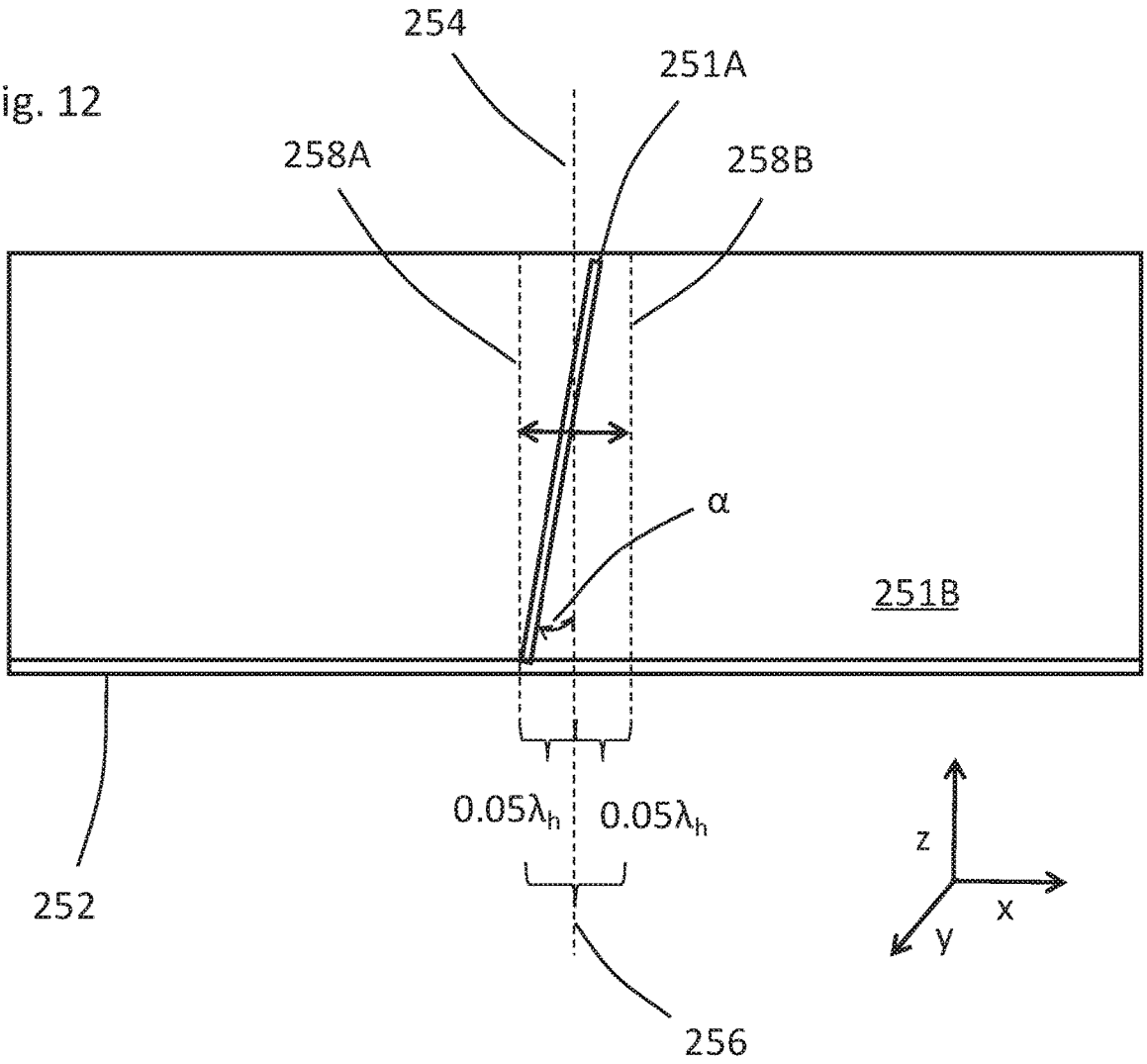
FIG. 12 is a schematic plan view of "thin" and "thick" isolation planes associated with a first sub-element of an element of an array antenna and the second sub-element rotated about a y-axis.

Characteristic of array antenna 20, and relevant to achieving an acceptable x-pol, is that the radiator structure 28A associated with the first sub-element 26A lies in the isolation plane 38B of the second sub-element 26B for each element 24A in the array 24 of the array antenna 20. This characteristic is also applicable to other embodiments that employ different types of antennas for the sub-elements, such as a dipole other than a sloping dipole, Vivaldi antenna, or BAVA antenna. While the isolation plane can be characterized as being immeasurably thin, the isolation plane as used herein is an isolation plane that has some depth or thickness. With reference to FIGS. 10-12, such an isolation plane is described with respect to a single element with T-dipole sub-elements. An element 240 includes a first sub-element 242A with a radiator structure 244A that extends between terminal ends 246A, 248A and a balanced feed structure 250A that splits the radiator structure 244A into two, substantially equal-length sections. The first sub-element 242A lies in and/or on a planar member 251A that is disposed perpendicular to a planar reflector or ground plane 252. The element 240 includes a second sub-element 242B with a radiator structure 244B that extends between terminal ends 246B, 248B and a balanced feed structure 250B that splits the radiator structure 244B into two, substantially equal-length sections. The second sub-element 242B lies in and/or on a planar member 251B that is disposed perpendicular to the planar reflector or ground plane 252. The second sub-element 242B, in operation, defines an immeasurably thin isolation plane 254. However, the thin isolation plane 254 is used to define a "thick" isolation plane 256 that has first and second planar surfaces 258A, 258B that are substantially parallel to one another. Further, each of the first and second planar surfaces 258A, 258B is spaced $0.05\lambda_h$ from the thin isolation plane 254, where $\lambda_h$ is the wavelength associated with the frequency that defines the high-end of the bandwidth of the radiator structure 244B. As shown in FIG. 10, the radiator structure 244A of the first sub-element 242A is within the isolation plane 256 even though the radiator structure 244A has been translated in the x-direction relative to being positioned so as to lie in the thin isolation plane 254. More generally, a radiator structure lies in a thick isolation plane if disposed substantially parallel to a thin isolation plane and not outside the thick isolation plane. With reference to FIG. 11, the radiator structure 244A can be rotated about a z-axis relative to being positioned such that the radiator structure 244A lies in the thin isolation plane 254, such that the radiator structure 244A is at an angle $\alpha$ to the thin isolation plane 254. As shown in FIG. 11, the radiator structure 244A has also been translated relative to being positioned in the thin isolation plane 254. The rotation and the translation has resulted in a portion of the radiator structure 244A lying outside the isolation plane 256 but at least half of the radiator structure lying within the isolation plane 256. Generally, provided at least half of a radiator structure remains within a thick isolation plane, the radiator structure lies in the isolation plane 256. With reference to FIG. 12, the planar member 251A that supports the first radiator structure 244A is shown as being rotated about a y-axis so as to make an angle $\alpha$ relative to the thin isolation plane 254. Since the entire planar member 251A lies within the thick isolation plane 256, the radiator structure 244A disposed on and/or in the planar member 251A also lies within the thick isolation plane 256. More generally, a radiator structure can be rotated about the y-axis and be considered within a thick isolation plane as long as at least half of the radiator structure remains within the thick isolation plane.

While the positioning of the first sub-element of an element within the isolation plane of the second sub-element of the element is relevant to achieving an acceptable x-pol, the positioning of the radiator associated with first sub-element so as to be substantially perpendicular to the radiator element of the second sub-element is also relevant to achieving an acceptable x-pol. With reference to FIG. 11, the radiator structure 244A can be rotated about a z-axis that is located in, or parallel to, the thin isolation plane 254, such that the radiator structure 244A is at an angle $\alpha$ to the thin isolation plane 254. If the angle $\alpha$ of rotation is greater than 10°, the resulting x-pol is likely to be unacceptable and the radiator structure 244A (or its related planar structure) is not deemed substantially perpendicular to the radiator structure 244B (or its related planar structure). With reference to FIG. 12, the planar member 251A that supports the radiator structure 244A is rotated about a y-axis that is located in, or parallel to, the thin isolation plane 254 such that the radiator structure 244A is at an angle $\alpha$ to the thin isolation plane 254. While the extent of this angle of rotation of a first sub-element that employs a T-dipole which has a linear radiator structure is of no consequence, when the radiator structure is two dimensional (e.g., sloping dipole, Vivaldi, BAVA etc.), an angle α that is greater than 10° is likely to result in an unacceptable x-pol and the radiator structure (or its related planar structure) is not deemed to be substantially perpendicular to the radiator structure of the other sub-element (or its related planar structure). This is the case even if more than half of the radiator structure remains within the thick isolation plane. It should be appreciated that a better x-pol is likely to be achieved the closer the radiator structure of a first sub-element is to being positioned entirely within the thin isolation plane. It should be further noted that the planar member 251A is substantially perpendicular to the ground plane 252 if the angle α is less than or equal to 10°. Similarly, the planar member 251B is substantially perpendicular to the ground plane 252 if a corresponding angle α is less than or equal to 10°.

Several of the embodiments of an array antenna with dual polarization elements described herein realize the antenna and the feed structure associated with the antenna of a sub-element using printed circuit board technology in which a planar conductive layer that is bonded to a planar, non-conductive substrate is etched (typically, done chemically but other conductive layer removal techniques can be used) to realize the antenna and feed structure associated with the antenna of a sub-element. Because portions of the conductive layer are removed to realize the antenna and feed structure associated with the sub-element, the printed circuit board manufacturing methodology can be characterized as a "subtractive" manufacturing technology. However, an antenna and/or feed structure associated with the antenna of a sub-element can also be realized by bonding/depositing metal to/on a planar, non-conductive substrate by techniques known to those skilled in the art. Further, combinations of subtractive and additive manufacturing techniques can be used to associate an antenna and related feed structure with a planar member to realize a sub-element.

In several of the embodiments of an array antenna with dual polarization elements described herein, the planar member associated with a number of sub-elements is implemented using the substrate associated with a single, printed circuit board to support each of the sub-elements. However, an antenna array with dual polarization elements of the kind described herein can be realized with a separate printed circuit board providing the support for the antenna and feed structure of the antenna for each sub-element in the array. Such an antenna array with dual polarization elements will likely require additional structure to support the sub-element circuit boards in the desired orientations. Also feasible is the use of a combination of one or more circuit boards that each provide the support for a single sub-element and one or more other circuit boards that each provide the support for two or more sub-elements. Further, such printed circuit boards can be replaced with other planar structures on/in which sub-elements are established with additive manufacturing techniques or combinations of subtractive and additive manufacturing techniques.

Several embodiments of the array antenna with dual polarization elements have been described in which the lattice that supports the elements of the array are realized, at least in part, using printed circuit boards with notch structures that allow one printed circuit board to engage another circuit board. Also possible is a monolithic lattice structure on/in which sub-elements are established using subtractive, additive, or a combination of additive and subtractive manufacturing techniques. The monolithic lattice structure can be realized using any number of manufacturing techniques known to those in the art, including molding, casting, 3-D printing, and CNC machining to name a few.

The array antenna 20 has been described as having sixty-four (64) elements. However, an array antenna can have as few as two elements if at least two of the elements are positioned with respect to one another in the range described with respect to FIGS. 3A and 3B. Such an antenna array would be limited to scanning in a vertical plane (i.e., a plane parallel to the plane of the first sub-elements). The addition of a third element as shown in any one of FIGS. 7-9 would provide the ability to scan in the horizontal plane (i.e., a plane parallel to the planes of the second sub-elements). Further, an array antenna can have more than sixty-four elements if needed or desired.

Several different embodiments of the printed circuit boards that support the sub-elements have been described as having a notching structure that facilitates the engagement of the printed circuit boards to one another. Typically, a first printed circuit board has a "long" notch and a second printed circuit board that is engaged by the first board has a corresponding "short" notch. Notches of substantially equal length are feasible. Further, notches that are in different locations from the locations illustrated and described are feasible, provided the engagement of the circuit boards leads to the boards being at least roughly perpendicular to one another an.

The foregoing description of the invention is intended to explain the best mode known of practicing the invention and to enable others skilled in the art to utilize the invention in various embodiments and with the various modifications required by their particular applications or uses of the invention.

What is claimed is:

1. An array antenna with dual polarization elements comprising:

a ground plane;

a first element and a second element with each of the first and second elements comprising:

a first polarization sub-element for processing a first linearly polarized portion of a signal, the first polarization sub-element having a first radiator structure extending between first terminal ends, a first balanced feed structure located between the first terminal ends, and, in operation, a first isolation plane located between the first terminal ends;

the first polarization sub-element lying in and/or on a first planar member that is substantially perpendicular to the ground plane, the first planar member defining a first plane;

a second polarization sub-element for processing a second linearly polarized portion of a signal, the second polarization sub-element having a second radiator structure extending between second terminal ends, a second balanced feed structure located between the second terminal ends, and, in operation, a second isolation plane located between the second terminal ends;

the second polarization sub-element lying in and/or on a second planar member that is substantially perpendicular to the ground plane;

wherein the first planar member and the first polarization sub-element are substantially perpendicular to the second planar member and the second polarization sub-element;

wherein the first radiator structure associated with the first planar member lies in the second isolation plane;

wherein the second planar member intersects the first plane at a location other than where the first isolation plane is located;

the first and second elements are positioned relative to one another such that:

the first planar member and the first polarization sub-element of the first element are coplanar with the first planar member and the first polarization sub-element of the second element;

the second planar member and the second polarization sub-element of the first element is parallel to, but not coplanar with, the second planar member and the second polarization sub-element of the second element.

2. An array antenna with dual polarization elements, as claimed in claim 1, wherein:

with respect to both the first and second polarization sub-elements, the second planar member of the second polarization sub-element intersects the first planar member of the first polarization sub-element at a location between the first balanced feed structure and one of the first terminal ends of the first polarization sub-element.

3. An array antenna with dual polarization elements, as claimed in claim 1, wherein:

with respect to both the first and second polarization sub-elements, the second planar member of the second polarization sub-element intersects the first plane of the first polarization sub-element at a location not between the first terminal ends of the first polarization sub-element and not at either of the first terminal ends of the first polarization sub-element.

4. An array antenna with dual polarization elements, as claimed in claim 1, wherein:

with respect to both the first and second polarization sub-elements, the second planar member of the second polarization sub-element intersects the first planar member of the first polarization sub-element at one of the first terminal ends of the first polarization sub-element.

5. An array antenna with dual polarization elements, as claimed in claim 1, wherein:

with respect to both the first and second polarization sub-elements, each of the first and second polarization sub-elements is one of: (a) a dipole antenna (b) a Vivaldi antenna, and (c) a balanced antipodal Vivalidi antenna.

6. An array antenna with dual polarization elements, as claimed in claim 1, further comprising:

a third element comprising:

a first polarization sub-element having a first radiator structure extending between first terminal ends, a first balanced feed structure located between the first terminal ends, and, in operation, a first isolation plane located between the first terminal ends;

the first polarization sub-element lying in and/or on a first planar member that is substantially perpendicular to the ground plane, the first planar member defining a first plane;

a second polarization sub-element having a second radiator structure extending between second terminal ends, a second balanced feed structure located between the second terminal ends, and, in operation, a second isolation plane located between the first terminal ends;

the second polarization sub-element lying in and/or on a second planar member that is substantially perpendicular to the ground plane;

wherein the first planar member and the first polarization sub-element are substantially perpendicular to the second planar member and the second polarization sub-element;

wherein the first radiator structure associated with the first planar member lies in the second isolation plane;

wherein the second planar member intersects the first plane at a location other than where the first isolation plane is located;

the first planar member of the third element is parallel to, but not coplanar with, the first planar member of each of the first and second elements.

7. An array antenna with dual polarization elements, as claimed in claim 6, wherein:

the second planar member of the third dual polarization element is coplanar with the second planar member of the second polarization sub-element of the first element.

8. An array antenna with dual polarization elements, as claimed in claim 6, wherein:

the second planar member of the third dual polarization element is coplanar with the first isolation plane of the first polarization sub-element of the first element.

9. An array antenna with dual polarization elements, as claimed in claim 8, wherein:

the intersection of the first and second planar members of the first element defines a side of the second planar member on which a greater portion of the first radiator structure of the first polarization sub-element lies; and a greater portion of the third radiator structure of the third dual polarization element lies on the correspondingly opposite side the second planar member of the third element.

10. An array antenna with dual polarization elements, as claimed in claim 8, wherein:

the intersection of the first and second planar members of the first element defines a side of the second planar member on which a greater portion of the first radiator structure of the first polarization sub-element lies; and a greater portion of the third radiator structure of the third dual polarization element lies on the correspondingly same side the second planar member of the third element.

11. An array antenna with dual polarization elements comprising:

a ground plane;

a first element and a second element with each of the first and second elements comprising:

a first polarization sub-element for processing a first linearly polarized portion of a signal, the first polarization sub-element having a first radiator structure extending between first terminal ends, a first balanced feed structure located between the first terminal ends, and, in operation, a first isolation plane located between the first terminal ends;

the first polarization sub-element lying in and/or on a first planar member that is substantially perpendicular to the ground plane;

a second polarization sub-element for processing a second linearly polarized portion of a signal, the second polarization sub-element having a second radiator structure extending between second terminal ends, a second balanced feed structure located between the second terminal ends, and, in operation, a second isolation plane located between the second terminal ends;

the second polarization sub-element lying in and/or on a second planar member that is substantially perpendicular to the ground plane;

wherein the first planar member and the first polarization sub-element are substantially perpendicular to the second planar member and the second polarization sub-element;

wherein the first radiator structure associated with the first planar member lies in the second isolation plane;

wherein the second planar member intersects the first planar member at a location other than where the first isolation plane is located;

the first and second elements are positioned relative to one another such that:

the first planar member and the first polarization sub-element of the first element is coplanar with the first planar member and the first polarization of the second element;

the second planar member and the second polarization sub-element of the first element are parallel to, but not coplanar with, the second planar member and second polarization sub-element of the second element;

the first planar member of the first element and the first planar member of the second element are embodied in a first, continuous, planar member;

the first, continuous, planar member defining a first notch located between the first balanced feed structure of the first polarization sub-element of the first element and the first terminal end of the first polarization sub-element of the second element that is closest to the first polarization sub-element of the first element;

second planar member of the second polarization sub-element of the first element defines a second notch that is located in the second isolation plane of the second polarization sub-element;

the first notch receiving a portion of the second planar member immediately adjacent to the second notch and the second notch receiving a portion of the first, continuous, planar member immediately adjacent to the first notch to join the first, continuous, planar member and the second planar member.

12. An array antenna, as claimed in claim 11, wherein:

the first notch is located between the first balanced feed structure of the first polarization sub-element of the first element and one of the first terminal ends of the first polarization sub-element of the first element.

13. An array antenna, as claimed in claim 11, wherein:

the first notch is located between the first terminal end of the first polarization sub-element of the first element and the first terminal end of the first polarization sub-element of the second element that is closest to the first terminal end of the first polarization sub-element of the first element.

14. An array antenna, as claimed in claim 11, wherein:

the first notch is located immediately adjacent to the first terminal end of the first polarization sub-element of the first element.

15. An array antenna, as claimed in claim 11, wherein:

the first planar member of the first element has an edge for engaging the ground plane, wherein the edge has a first linear section, a second linear section that is colinear with the first linear section, and a tab located between and extending away from the first and second linear sections and supporting a portion of the first balanced feed structure of the first polarization sub-element of the first element; and the ground plane defines a slot for receiving the tab of the first planar member.

16. An array antenna, as claimed in claim 11, wherein:

the first planar members of the first and second elements are embodied in a single, continuous planar member that has an edge for engaging the ground plane, wherein the edge has first, second, third, and fourth linear sections that are colinear with one another, a first tab located between and extending away from the first and second linear section and a second tab located between and extending away from the third and fourth linear sections, the first tab supporting a portion of the first balanced feed structure of the first polarization sub-element of the first element and the second tab supporting a portion of the first balanced feed structure of the first polarization sub-element of the second element; and the ground plane defining a first slot for receiving the first tab of the first planar member and a second slot for receiving the second tab of the first planar member.

17. An array antenna, as claimed in claim 11, further comprising:

a third element comprising:

a first polarization sub-element having a first radiator structure extending between first terminal ends, a first balanced feed structure located between the first terminal ends, and a first isolation plane located between the first terminal ends;

the first polarization sub-element lying in and/or on a first planar member that is substantially perpendicular to the ground plane;

a second polarization sub-element having a second radiator structure extending between second terminal ends, a second balanced feed structure located between the second terminal ends, and a second isolation plane located between the first terminal ends;

the second polarization sub-element lying in and/or on a second planar member that is substantially perpendicular to the ground plane;

wherein the first planar member and the first polarization sub-element are substantially perpendicular to the second planar member and the second polarization sub-element;

wherein the first radiator structure associated with the first planar member lies in the second isolation plane;

wherein the second planar member intersects the first planar member at a location other than where the first isolation plane is located;

the first planar member of the third element is parallel to the first planar member of each of the first and second elements;

the first planar member of the third element defines a third notch;

the second planar member of the third element defines a fourth notch that is located in the second isolation plane of the second polarization sub-element of the third element;

the third notch receiving a portion of the second planar member located immediately adjacent to the fourth notch and the fourth notch receiving a portion of the first planar member located immediately adjacent to the third notch.

18. An array antenna with dual polarization elements, as claimed in claim 17, wherein:

the second planar member of the first element and the second planar member of the third element are embodied in a second, continuous, planar member.

19. An array antenna with dual polarization elements, as claimed in claim 17, wherein:

the first planar member of the first element defines a fifth notch located in the first isolation plane;

the second planar member of the third element defines a sixth notch;

wherein the fifth notch receiving a portion of the second planar member located immediately adjacent to the sixth notch and the sixth notch receiving a portion of the first planar member located immediately adjacent to the fifth notch.

* * * * *